US009498039B2

(12) United States Patent
Matsui et al.

(10) Patent No.: US 9,498,039 B2
(45) Date of Patent: Nov. 22, 2016

(54) HEATING BLOWER

(71) Applicant: Panasonic Intellectual Property Management Co., Ltd., Osaka (JP)

(72) Inventors: Yasunori Matsui, Shiga (JP); Mitsue Wakabayashi, Shiga (JP); Mayuka Kambayashi, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 64 days.

(21) Appl. No.: 14/668,841

(22) Filed: Mar. 25, 2015

(65) Prior Publication Data

US 2015/0289623 A1 Oct. 15, 2015

(30) Foreign Application Priority Data

Apr. 11, 2014 (JP) ..... 2014-081549

(51) Int. Cl.
*A45D 20/08* (2006.01)
*A45D 20/12* (2006.01)
*H01T 23/00* (2006.01)

(52) U.S. Cl.
CPC ..... *A45D 20/12* (2013.01); *H01T 23/00* (2013.01); *A45D 2200/202* (2013.01)

(58) Field of Classification Search
CPC ..... F26B 11/00; F26B 21/00; F26B 21/06; A45D 20/00; A45D 20/08; A45D 20/12; A45D 20/20
USPC ..... 34/97, 98, 99; 392/384, 385; 8/132
See application file for complete search history.

(56) References Cited

U.S. PATENT DOCUMENTS 6,640,049 B1 * 10/2003 Lee ..... A45D 20/08 34/96
7,644,511 B2 * 1/2010 Ishikawa ..... A45D 20/12 132/220
8,015,724 B2 * 9/2011 Imahori ..... A45D 20/12 118/723 R
8,387,271 B2 * 3/2013 Shami ..... A45D 20/12 132/211
8,455,796 B2 * 6/2013 Leung ..... A45D 1/04 132/223
8,898,929 B2 * 12/2014 Stewart ..... D06F 59/04 134/103.2

(Continued)

FOREIGN PATENT DOCUMENTS

EP 2564723 A1 3/2013
JP 2004-057556 A 2/2004

(Continued)

OTHER PUBLICATIONS

The Extended European Search Report dated Jul. 31, 2015 for the related European Patent Application No. 15163090.2.

*Primary Examiner* — Stephen M Gravini
(74) *Attorney, Agent, or Firm* — McDermott Will & Emery LLP

(57) ABSTRACT

A heating blower such as a hair dryer includes a generator and a controller both disposed in a housing in which a blowing path is formed. The generator includes at least one of an ion generator for generating an ion, an acid component generator for generating an acid component, and a charged particulate liquid for generating a charged particulate liquid. The controller controls an amount of the component generated by the generator. The controller further performs control such that the amount of the component decreases after a lapse of predetermined time or with a lapse of time from an operation start of the generator. The foregoing structure allows supplying hair with the component in an amount adequate to a dry state of the hair.

5 Claims, 17 Drawing Sheets

(56) References Cited

U.S. PATENT DOCUMENTS

| | | | | |
|---|---|---|---|---|
| 9,326,578 | B2 * | 5/2016 | Yoshidome | A45D 20/10 |
| 2005/0198853 | A1 | 9/2005 | Cafaro | |
| 2005/0198855 | A1 | 9/2005 | Cafaro et al. | |
| 2006/0032077 | A1 | 2/2006 | Cafaro | |
| 2006/0201016 | A1 * | 9/2006 | Nakagawa | A45D 20/12 34/96 |
| 2010/0170104 | A1 | 7/2010 | Shami et al. | |
| 2015/0289623 | A1 * | 10/2015 | Matsui | H01T 23/00 34/97 |

FOREIGN PATENT DOCUMENTS

| | | | | |
|---|---|---|---|---|
| JP | 2004-081824 | A | 3/2004 | |
| JP | EP 1685775 | A1 * | 8/2006 | A45D 20/12 |
| JP | 2007-528272 | A | 10/2007 | |
| JP | EP 2140777 | A3 * | 6/2010 | A45D 20/12 |
| JP | WO 2013069391 | A1 * | 5/2013 | A45D 20/12 |
| JP | EP 2929799 | A1 * | 10/2015 | H01T 23/00 |
| KR | 100704354 | B1 * | 4/2007 | A45D 20/12 |
| WO | 2005/087038 | A1 | 9/2005 | |

* cited by examiner

HEATING BLOWER

RELATED APPLICATIONS

This application is claims the benefit of Japanese application No. 2014-081549, filed on Apr. 11, 2014, the disclosure of which is incorporated by reference herein.

FIELD OF THE INVENTION

The present disclosure relates to a heating blower that discharges heated hot air.

BACKGROUND OF THE INVENTION

A conventional heating blower that includes an Ion generator has been known in the market. (e.g. Refer to Japanese Examined Patent Publication No. 2007-528272)

The heating blower disclosed in this patent generates an ion component in the ion generator by applying a high voltage across a first electrode and a second electrode for generating an electric discharge, and then blows the generated ion from an air outlet. Supply of the ion component to hair of a user's head allows enhancing hair-care effect. An amount of the ion component to be generated can be set to any value, so that an optimum amount of the ion component can be supplied in response to a thickness of hair.

SUMMARY OF THE INVENTION

The conventional structure discussed above; however, maintains a constant amount of the ion component although a dry state of hair has been changed by hot air discharged from the heating blower. The amount of ion component is thus sometimes not optimum to a dry state of hair, so that the hair cannot receive a sufficient effect from the heating blower.

The present disclosure addresses the foregoing problem, and aims to provide a heating blower that can supply hair with ion component in an amount adequate to a dry state of hair. The heating blower of the present disclosure includes a housing, fan, heater, generator, and controller in order to solve the foregoing problem.

The housing forms an enclosure, and includes a blowing path disposed inside the housing and running from a suction port to a discharge port. The fan is disposed inside the housing at the suction port side for generating an airflow in the blowing path. The heater is disposed inside the housing at the discharge port side for heating the airflow. The generator is disposed inside the housing for supplying the generated component to the airflow. The controller controls an amount of the component generated by the generator.

The generator includes at least one of an Ion generator that generates ion, an acid component generator that generates an acid component, and a charged particulate liquid generator that generates a charged particulate liquid.

The controller controls such that the amount of component generated by the generator decreases in a given time or with the laps of time from an operation start of the generator.

According to the present disclosure, an optimum amount of ion component can be supplied in response to a dry state of hair. The heating blower of the present disclosure, as a result, allows providing the hair with hair-care such as the hair can be bound up with ease, or the hair feel soft.

DETAILED DESCRIPTION OF THE PREFERRED EMBODIMENT

Figure 1:
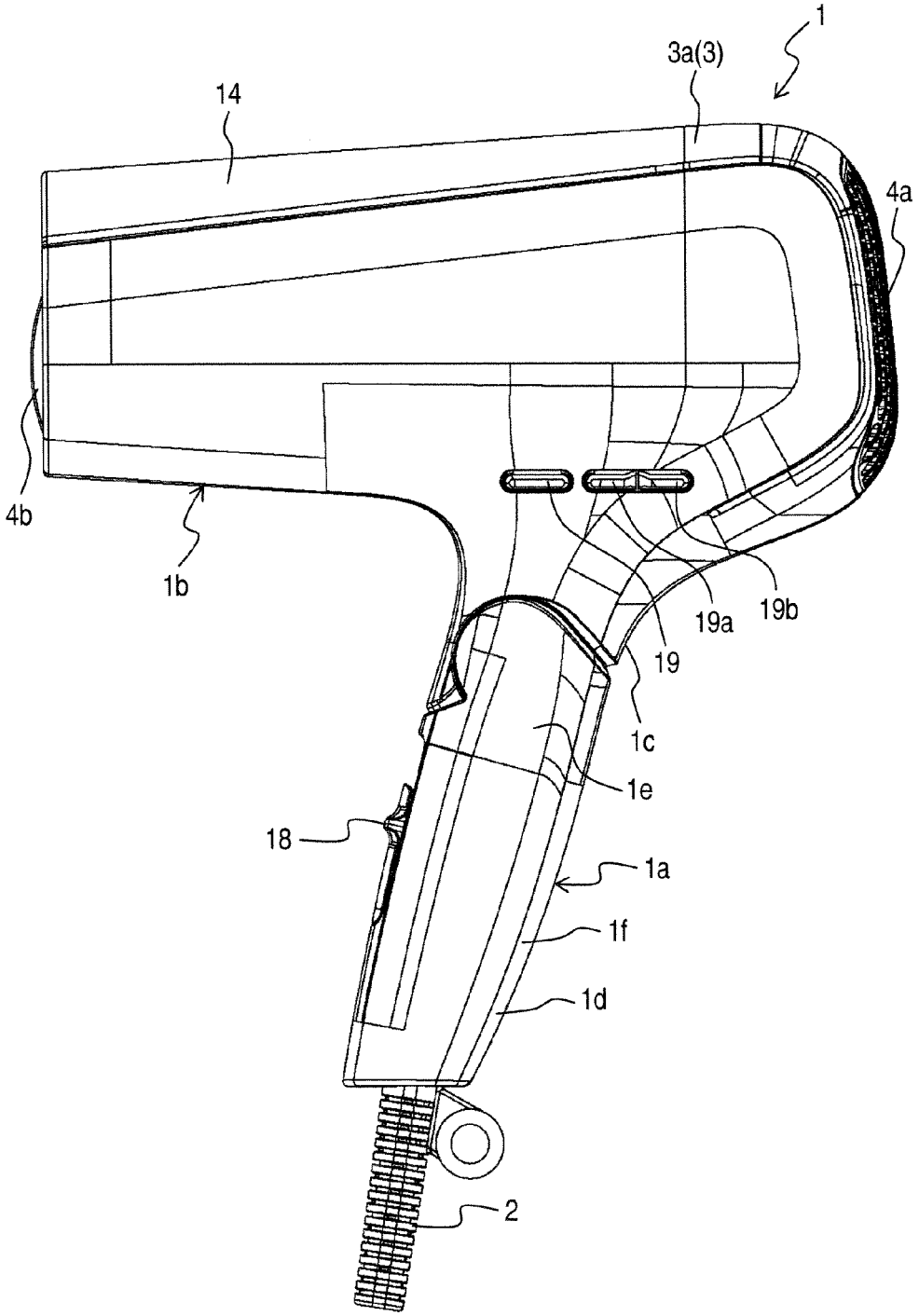
FIG. 1 is a lateral view of a heating blower in accordance with an embodiment of the present disclosure.

A heating blower in accordance with an embodiment of the present disclosure comprises the following structural elements: a housing, fan, heater, generator, and controller.

The housing forms an enclosure, and includes a blowing path disposed inside the housing and running from a suction port to a discharge port. The fan is disposed inside the housing at the suction port side for generating an airflow in the blowing path. The heater is disposed inside the housing at the discharge port side for heating the airflow. The generator is disposed inside the housing for supplying the generated component to the airflow. The controller controls an amount of the component generated by the generator. The generator includes at least one of an ion generator that generates ion, an acid component generator that generates an acid component, and a charged particulate liquid generator that generates a charged particulate liquid. The controller controls such that the amount of component generated by the generator decreases in a given time or with the laps of time from an operation start of the generator.

This embodiment allows adjusting a production amount of the component in response to a dry state of hairs, whereby a more optimum amount of the component can be supplied to the hair.

The controller can includes a first control mode and a second control mode. The first control mode sets an amount of at least one component out of components generated by the generator to a given amount, and the second control mode sets an amount of at least one component out of the components generated by the generator to an amount smaller than the amount set by the first control mode.

The embodiment allows setting the first control mode as having at least an amount of one of ion, acid component, charged particulate liquid greater than amounts of the other two elements so that the first control mode becomes adequate to thick hairs. The second control mode, on the other hand, can be set as having at least an amount of one of ion, acid component, charged particulate liquid smaller than amounts of the other two elements so that the second control mode becomes adequate to thin hairs. As a result, the first control mode finishes the thick hairs moistly to be bound up with ease, and the second control mode finishes the thin hairs loosely and softly.

The controller can perform control such that the production of the components can be halted for a given time before decreasing an amount of at least one component generated by the generator.

According to the embodiment, an electrification around at least one of the ion generator, acid component generator, and charged particulate liquid generator can be removed. As a result, after the halt for the given time, a production amount of at least one of the ion, acid component, and charged particulate liquid can be stabilized at the re-start of operation after the halt of the operation.

In the case of the generator including the ion generator, this structure allows reducing an amount of ion produced in response to a dry state of hair, thereby preventing excessive electric charges on the surface of dried hair, so that a bind-up of the hair or a run of fingers through the hair can be done with more ease.

In the case of the generator including the acid component generator, this structure allows reducing an amount of acid component in response to the dry state of hair, thereby preventing an excessive contraction of the hair due to the acid component on the surface of the hair, so that an extension of twisted (curly) hair can be improved or the hair feel smoother.

In the case of the generator including the charged particulate liquid generator, this structure allows reducing an amount of the charged particulate liquid in response to the dry state of hair, thereby lowering moderately a moist feel of the hair, so that the hair can be finished silky, softly, and loosely.

A charge supply panel that is capable of changing a charged state of hair can be disposed near a handle of the drying blower, and the controller controls a charge amount of the charge supply panel.

This embodiment allows the controller to control the charge amount of the charge supply panel, so that electric charges on a body of a user who grasps the charge supply panel is adjustable. As a result, this structure allows at least one of ion, acid component, and charged particulate liquid to attach to the hair in a stable amount.

The embodiment is detailed hereinafter with reference to the accompanying drawings. The present disclosure is not limited to this embodiment. FIG. 1 is a lateral view of the heating blower in accordance with the embodiment. A hair dryer is taken as an example of the heating blower. Hair dryer 1 includes handle 1*a* and main body 1*b* connected to handle 1*a* in a direction crossing handle 1*a*. Handle 1*a* can be folded up, and when this hair dryer is in use, handle 1*a* and main body 1*b* form together roughly letter T or letter L (this embodiment uses a shape of letter T).

An end of handle 1*a* is connected with power cord 2. Handle 1*a* is divided into root section 1*c* closer to main body 1*b* and tip section 1*d*. Root section 1*c* and tip section 1*d* are pivotally coupled together via junction 1*e*. Tip section 1*d* can be folded closely to main body 1*b*.

Housing 3 forming an enclosure of hair dryer 1 is built by connecting multiple split pieces together. Inside housing 3, a space is formed, and a variety of electric components are accommodated in this space.

Figure 5:
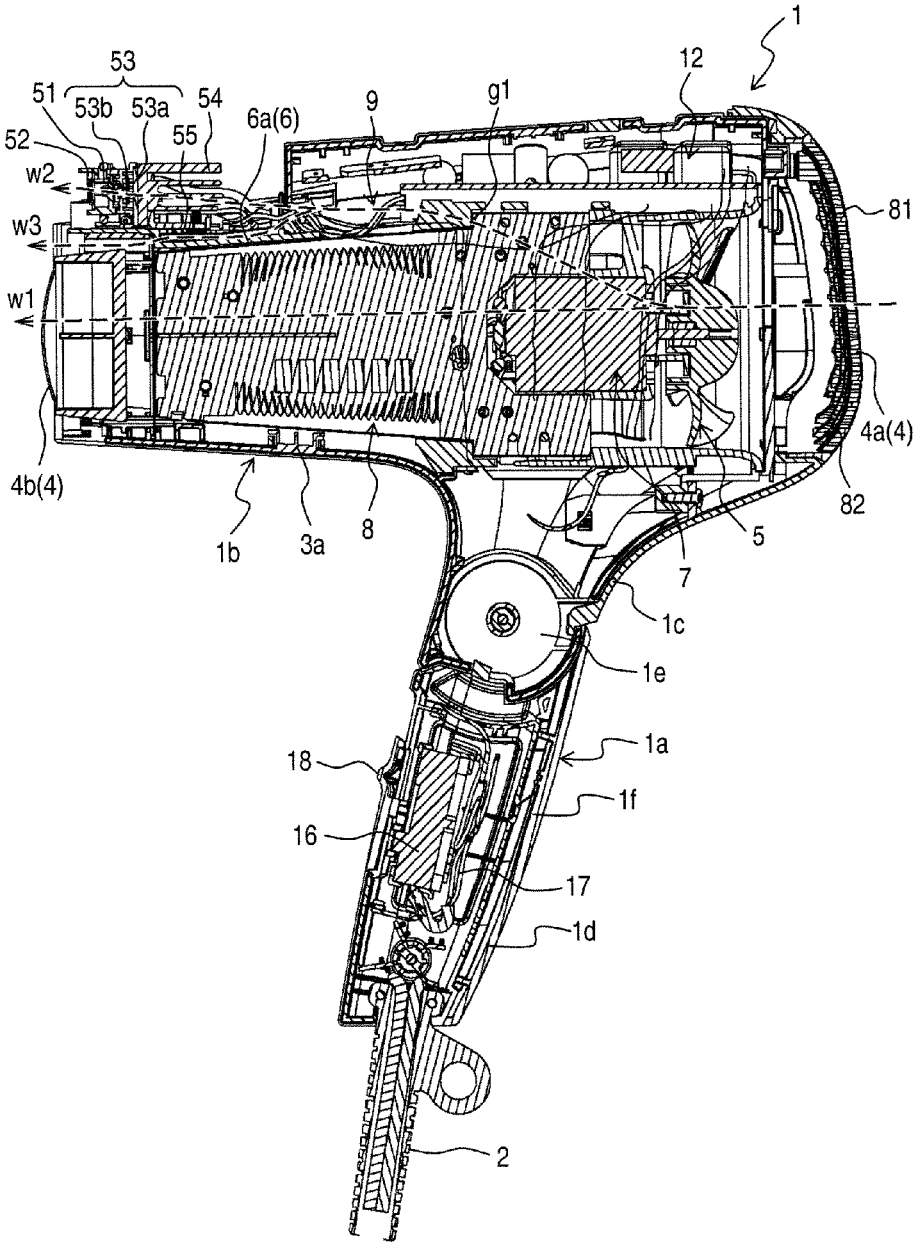
FIG. 5 is a sectional view cut along line 5-5 of FIG. 4

Inside main body 1*b*, inlet opening 4*a* that is the suction port of air is disposed on a first side (right side in FIG. 5) along the longer side direction (left-right direction in FIG. 5), and outlet opening 4*b* that is the discharge port of air is disposed on a second side (left side in FIG. 5).

Air duct 4 is formed as the blowing path extending across inlet opening 4*a* and outlet opening 4*b*. Fan 5 is accommodated in air duct 4, and fan 5 is spun as a blower, thereby generating airflow W1. In other words, airflow W1 flows from the outside into air duct 4 via inlet opening 4*a*, and travels through air duct 4 before discharged from outlet opening 4*b* to the outside.

Inlet opening 4*a* is covered with mesh-like frame 81 which has honeycomb shaped openings 81*a*. This structure allows maintaining uniform strength of sash bars 81*b* while a total opening area of inlet opening 4*a* is maximized, thereby expecting a greater air volume to be sucked.

As FIG. 5 shows, frame 81 is integrated with mesh 82 of which opening ratio ranging from 55-90% and mesh-width ranges from 300-650 μm. Mesh 82 can be made of metal or fire-retardant resin such as polyester. The integral molding of mesh 82 having such fine mesh into frame 81 allows preventing more positively tiny dust, hairs, and the like from entering the airflow path.

Inside outer cylinder 3*a* of housing 3 in main body 1*b*, inner cylinder 6 shaped like a cylinder is provided so that airflow W1 can flow inside inner cylinder 6. Inside inner cylinder 6, fan 5 is disposed at mostly upstream position of airflow W1, motor 7 is disposed at a downstream position from fan 5, and heater 8 is disposed at a downstream position from motor 7.

When heater 8 is in operation, hot air blows out from outlet opening 4*b*. In this embodiment, heater 8 is formed by rolling a belt-like corrugated panel of electric resistant body along an inner wall of inner cylinder 6, however; heater 8 is not limited to this structure.

The generator is disposed inside housing 3, and this generator includes at least one of an ion generator for generating ion, an acid component generator for generating an acid component, and a charged particulate liquid generator for generating a charged particulate liquid.

The ion generator is formed of, for instance, an acicular first electrode and an annular second electrode, and a high voltage is applied across these electrodes for generating the ion.

The charged particulate liquid generator is formed of, for instance, an acicular first electrode and an annular second electrode, and a high voltage is applied across these electrodes for generating the charged particulate liquid. When the charged particulate liquid is generated, the liquid for generating the charged particulate liquid is supplied to the first electrode, and then the high voltage is applied across these electrodes.

The liquid is supplied to the first electrode by using, for instance, a tank containing the liquid. Here is another way: the first electrode is cooled for obtaining dew formation on the surface of the first electrode, and this dew formation of water is used as the liquid to be supplied to the first electrode. The liquid can be water resulting from the dew formation, water resulting from the dew formation of component dissolved from the first electrode, or water resulting from the dew formation of component dissolved from surrounding structures of the first electrode.

The acid component generator can employ any method that generates the acid component, for instance, it is formed of a first electrode and a second electrode, and a high voltage is applied across these electrodes for generating an electric discharge, thereby generating $NO_x$—$(H_2O)_n$ or the like containing acid component.

The acid component can be generated by electro-statically atomizing or vaporizing a liquid of acid properties, or by depositing a solid.

In this embodiment, metal particulate generators 30, 40 and mist generator 50 are disposed in space 9 formed between housing 3 and inner cylinder 6 inside main body 1*b*. Metal particulate generators 30, 40 and mist generator 50 form generator 60 that generates component, which is discharged together with split-flow W2; however, the component can be discharged together with airflow W1 from outlet opening 4*b*.

Generator 60 can be disposed inside inner cylinder 6 where heater 8 is disposed; however, as the embodiment shows, generator 60 is preferably disposed at a place not heated by heater 8.

Metal particulate generators 30, 40 generate metal particulate, ion, and acid component. Mist generator 50 generates charged particulate liquid, ion, and acid component.

As discussed above, in this embodiment metal particulate generators 30, 40 serve the functions of both of the ion generator and the acid component generator. Mist generator 50 serves as the functions of the charged particulate liquid generator, ion generator, and acid component generator.

To be more specific, inside housing 3, there are three types of generators, namely, the ion generator for generating ion, the acid component generator for generating acid component, and the charged particulate liquid generator for generating charged particulate liquid. The ion generator and the acid component generator are disposed at three places respectively, and the charged particulate liquid generator is disposed at one place.

The foregoing three types of generators can be disposed independently of each other, and it is not necessarily to prepare all the three types of generators, for instance any one of three types can be disposed inside housing 3, or randomly selected two types out of three types can be disposed inside housing 3.

In this embodiment, each amount of generated ion, charged particulate liquid, metal particulate, acid component is controlled by controller 10, and is supplied appropriately in response to the condition (nature, length, dry state) of hair.

Space 9 formed between housing 3 and inner cylinder 6 inside main body 1*b* accommodates voltage-applying circuit 12 that applies a voltage to mist generator 50. Another voltage-applying circuit (not shown) for applying a voltage to metal particulate generators 30, 40 is also accommodated in housing 3; however, it is accommodated in a different place from voltage-applying circuit 12 in order to avoid a failure caused by mutual interference.

Voltage applying circuit 12 and another voltage applying circuit (not shown) that applies a voltage to metal particulate generators 30, 40 are preferably disposed inside handle 1*a*, or at a place inside main body 1*b* yet on an extension line from handle 1*a*. Because when a user holds handle 1*a*, a rotary moment caused by the mass of voltage applying circuit 12 and another voltage applying circuit (not shown) should be small enough to reduce load acting to the user.

Voltage applying circuit 12 is preferably placed opposite to another voltage applying circuit (not shown) relative to inner cylinder 6 disposed between these two circuits. This structure allows preventing more positively the mutual interference that incurs failures such as a drop or instability in voltage.

In this embodiment, space 9 accommodates switch section 21 at a lateral section (different section from a place where voltage applying circuit 12 is accommodated). Switch section 21 switches hot-air to cold-air or switches operation modes.

Tip section 1*d* of handle 1*a* includes a space which accommodates another switch section 16 that switches power ON to power OFF of a power supply. Those electric components are connected together with lead-wire 17 of which metal-conductive core-wire is covered with insulating resin.

Each one of lead-wires 17 connected to metal particulate generators 30, 40 and mist generator 50 is preferably separated from each other as far as possible to avoid crossing each other. This structure prevents mutual interference between electric currents flowing through each of lead-wires 17, because the mutual interference causes a failure in obtaining desirable voltages or incurs unstable voltages at metal particulate generators 30, 40 and mist generator 50.

In this embodiment, switch section 16 includes slide-switch 18 exposed from the surface of housing 3, and the user operates slide-switch 18 for switching open/close of interior contacts. Sliding slide-switch 18 in an up-down direction allows switching open/close of the interior contacts in multiple steps.

For instance, the switching in multiple steps is carried out in four modes (e.g. power-off, breeze, middle wind, and strong wind). Slide-switch 18 at the lowest position indicates the power-off. Slide-switch 18 is slid one step up to indicate the breeze mode, then slide-switch 18 is slid one more step up to indicate the middle wind mode. Slide-switch 18 is then slid to the upper most position to indicate the strong mode.

Switch section 21 that switches hot-air/cold-air or switches operation modes works such that switches 19, 19*a*, and 19*b* provided on the lateral face of housing 3 are operated (pressed), thereby switching open/close the interior contacts. Display section 14 is disposed at an upper section of main body 1*b*, and display section 14 displays a mode selected at present.

Switch section 21 and display section 14 are connected electrically to controller 10.

In this embodiment, an operation of switch 19 allows switching from/to hot-air to/from cold-air. Every time when switch 19 is operated, not only switching between the two wind temperature modes (i.e. HOT and COLD), but also switching among four wind temperature modes (i.e. HOT, HOT & COLD, COLD, and SCALP) can be done.

In this case, it is preferable to display some letters on display section 14 so that a selected mode can be recognized. Hereinafter, an example of each mode and a method for displaying the mode on display section 14 is demonstrated. The mode of HOT refers to a mode of supplying the hot air. This mode allows air of approx. 70-80° C. to blow to hair. A selection of the HOT mode prompts display section 14 to show the letters of HOT.

The mode of HOT & COLD supplies hot-air and cold-air alternately, for instance, cold air for 5 seconds, and hot air for 7 seconds. A selection of the HOT & COLD mode prompts display section 14 to show an arrow, and yet shows HOT or COLD alternately in response to an output of hot-air or cold-air.

The mode of COLD refers to a mode of supplying cold-air. The COLD mode allows the cold air of approx. 30° C. to blow to the hair. A selection of the COLD mode prompts display section 14 to show the letters of COLD.

The mode of SCALP refers to a mode of supplying warm-air, and this mode allows warm-air of approx. 50° C. to blow to the hair. The SCALP mode is established to be selected chiefly for caring the scalp. A selection of the SCALP mode prompts display section 14 to show the letters of SCALP.

Switch 18 is slid upward to turn on the power supply, then controller 10 is powered, whereby heater 8 is driven with a driving signal in response to a presently selected wind temperature mode, and display section 14 is controlled such that it displays the presently selected wind temperature mode. The action of sliding switch 18 upward for the power supply to be turned on allows only selecting the HOT mode, so that hot-air is blown.

Every time when switch 19 is operated, a depressing signal is sent to controller 10, so that the four wind temperature modes are switched sequentially from the HOT & COLD mode, COLD mode, SCALP mode, and HOT mode.

In this embodiment, letters of SKIN is prepared in display section 14. When the COLD mode is selected, SKIN is displayed together with COLD. In other words, a selection of the COLD mode during the breeze mode allows the user to use the hair dryer in SKIN mode, which blows cold air containing mist to skin for maintaining moisture appropriately. The SKIN mode is thus selected for caring about skin.

The foregoing description is merely an example, and a variety of methods for displaying each mode are available. Specifically, various modes can be set for switching the hot-air to the cold-air.

In this embodiment, hair dryer 1 includes temperature sensor 25 for sensing environmental temperatures (e.g. atmospheric temperature, room temperature). Controller 10 varies an electric power to be supplied to heater 8 in response to the environmental temperature sensed by sensor 25.

Figure 6:
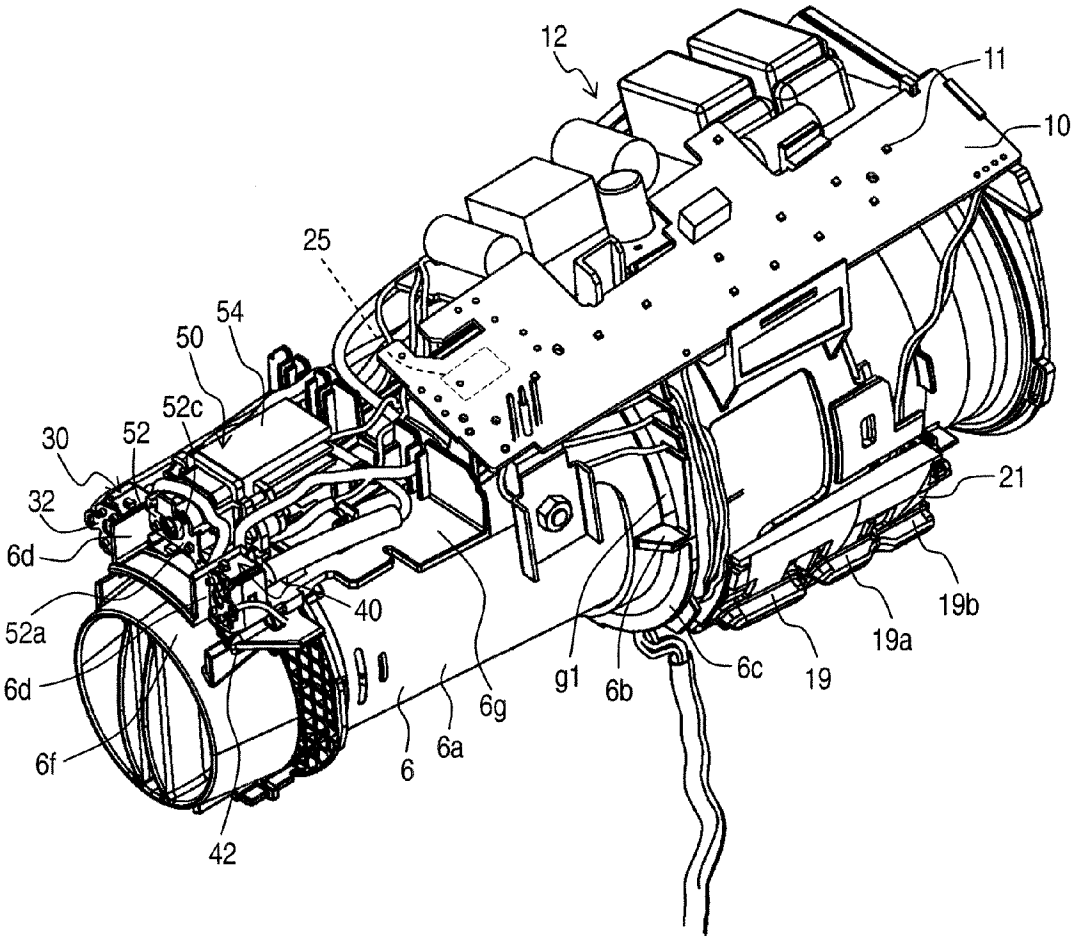
FIG. 6 is a perspective view showing a portion inside a heating blower in accordance with an embodiment, and in which portion an ion generator, an acid component generator, and a charged particulate liquid generator are provided.
Figure 7:
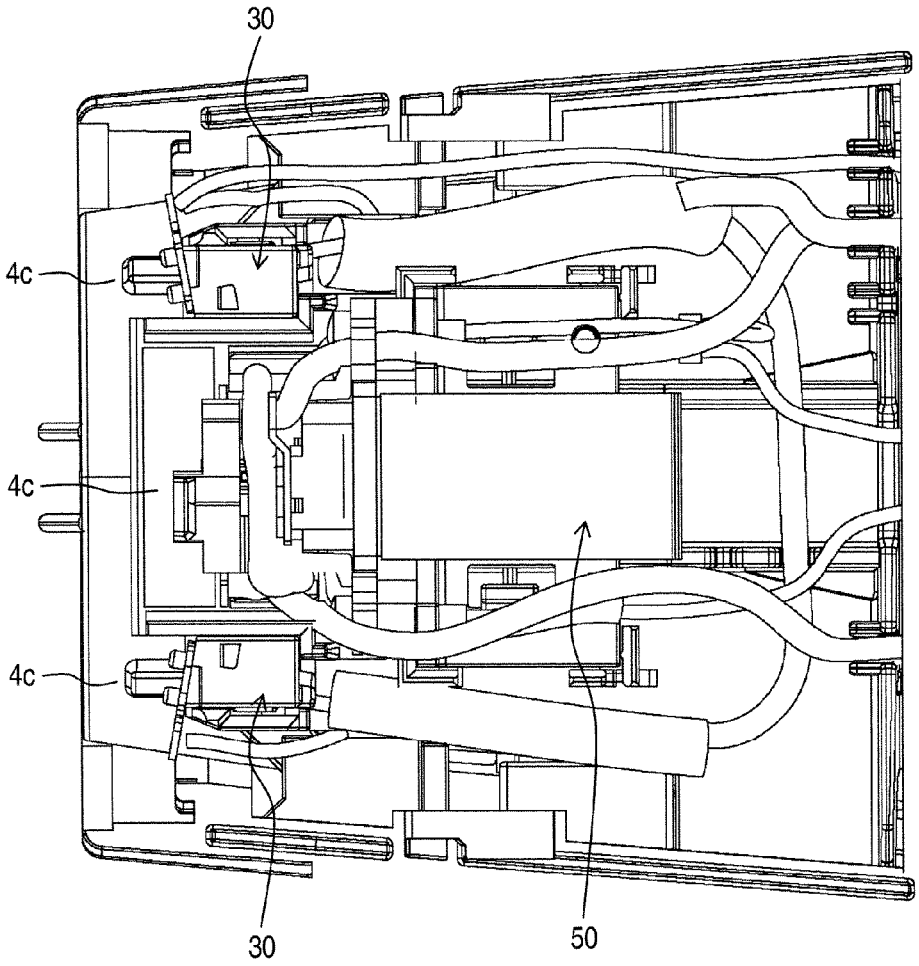
FIG. 7 is an enlarged plan view showing the portion inside the heating blower in accordance with the embodiment, and in which portion the ion generator, the acid component generator, and the charged particulate liquid generator are provided.

Temperature sensor 25 is disposed downstream from fan 5 prepared inside hair dryer 1 so that sensor 25 can escape from influence of the heat produced by heater 8. As FIG. 6 shows, temperature sensor 25 is placed downstream from gap g1 in wind tunnel 9B (outside of inner cylinder 6).

Temperature sensor 25, in a state hard to be affected by the heat from heater 8, senses the environmental temperature, and controller 10 controls the electric power to be supplied to heater 8 in response to the sensed environmental temperature.

For instance, at the environmental temperature of 10° C., controller 10 allows supplying a greater amount of electric current to heater 8 for producing hot air ranging 110-130° C. and preferably at 120° C. At the environmental temperature of 30° C., controller 10 allows reducing the electric current amount to heater 8 for producing hot air of which temperature ranges 50-70° C. and preferably at 60° C.

In this embodiment, an operation of switch 19*a* allows hair-type modes to be switched based on a hair type. To be more specific, two hair-type modes are available, namely, a thick hair mode that is selected chiefly by users having thick hairs, and a thin hair mode that is selected chiefly by users having thin hairs. A component amount produced by generator 60 can be adjusted based on the selected hair type mode. A specific method for adjusting the amount will be described later.

In this embodiment, an operation of switch 19*b* allows hair-length modes to be switched based on a hair length. To be more specific, three hair-length modes are available, namely, a short-hair mode that needs a shorter time to be dried and is selected chiefly by users having short hairs, a long-hair mode that needs a longer time to be dried and is selected chiefly by users having long hairs, and a medium-hair mode that is selected chiefly by users having hairs of medium length. A component amount produced by generator 60 can be adjusted based on the selected hair length mode. A specific method for adjusting the amount will be described later.

A selection of the hair-type mode and the hair-length mode can be shown on display section 14 in various ways. For instance, a selection of the long-hair mode prompts display section 14 to show letters or an illustration indicating long hairs. In other words, a mode selected from the hair-type modes or the hair-length modes can be displayed for the user to identify the selected mode with letters or an illustration indicating the length of hairs.

During a regular operation of hair dryer 1 in accordance with the embodiment, hair dryer 1 is controlled such that a component amount produced by generator 60 becomes smaller than the amount at the operation start in due course of the operation. For each selected hair-length mode, a necessary time before the amount of produced component reaches a given amount differs from each other. This necessary time refers to a time until the ratio of an amount vs. the amount at the operation start reaches a given value. In the case of displaying a selected hair length mode, a time until the component amount decreases can be shown on display section 14.

Hair dryer 1 in accordance with the embodiment produces different amounts of component depending on the selected hair type mode. This is detailed later. In other words, controller 10 controls the production amount such that a smaller amount is produced in a first control mode than an amount produced in a second control amount. In the case of displaying a selected hair type mode, a produced amount of component can be shown simultaneously.

As discussed above, not only a selected mode such as a hair-type mode or a hair-length mode, but also various states can be shown on display section 14. For instance, a produced amount of ion, charged particulate liquid, or acid component can be shown on display section 14. A change in the production amount can be also displayed.

Driving states in two control modes can be shown on display section 14. For instance, volume-up and volume-down that indicate hair-care effects can be shown on display section 14.

Display section 14 is formed of chip-type LED 11, diffusion plate 13 colored in white or opaque-white for diffusing the light from LED 11, and display panel 15 made of transparent resin. Display panel 15 can be formed separately from housing 3, and fixed to housing 3 with a double-sided adhesive tape, or it can be integrally formed with housing 3. A half-mirror layer is preferably printed or transcribed on a rear face of display panel 15. A light shielding layer is preferably printed or painted on a top face, which confronts LED 11, of the half-mirror layer so that the light from LED 11 can be selectively shielded. The selective shield refers to a shielding at a specific region (e.g. region other than letters) for letters or an illustration to be shown. The letters include, for instance, HOT, HOT & COLD, COLD, SCALP, or SKIN.

The foregoing structure of display section 14 allows interior components of hair dryer 1 or letters in light-out state to be hardly seen because external light is reflected on the half-mirror layer.

A power-on of hair dryer 1 prompts LED 11 to emit light, which travels through the light shielding layer and the half-mirror layer before radiating to the outside. At this time, the light-shielding layer shields the light at the regions other than letters, so that the letters only are disclosed externally.

LED 11 can emit light in different colors depending on letters or an illustration to be displayed, or LED 11 can emit light always in the same color.

The print color of display section 14 can be changed depending on the color of main body 1*b*; however, a print in a single color cannot shield the light sufficiently, so that it is preferable to print in an appearance color first, and then print in silver-based color that uses an ink containing metal powder at a high ratio for shielding light.

Inner cylinder 6 includes tubular section 6*a*, multiple supporting ribs 6*b* (in FIG. 6, only one rib is shown), and flange 6*c*. Multiple supporting ribs 6*b* extend from tubular section 6*a* outward along a radial direction and are dispersedly disposed along a circumference direction. Flange 6*c* is connected to tubular section 6*a* via supporting ribs 6*b*, and extends along a direction crossing an axial direction of tubular section 6*a* at approx. right angles.

Gap g1 is formed between tubular section 6*a* and flange 6*c*. Airflow W1 branches into parts via gap g1, and then a part thereof enters space 9, whereby branched airflow W2 is formed. Gap g1 functioning as a guide port for branched airflow W2 to enter space 9 is located downstream from fan 5, and yet upstream from heater 8. Branched airflow W2 thus forms a comparatively cool airflow before it is heated by heater 8.

A part of branched airflow W2 further branches into branched airflow W3, which bypasses metal-particulate outlets 20*a*, 20*b* and mist outlet 20*c* (detailed later) and travels between inner cylinder 6 and housing 3 before blowing off from an outer wall of outlet opening 4*b*. Branched airflow W3 forms a comparatively cool airflow.

Housing 3 includes arc-shaped through-hole 3*b* at outlet opening 4*b* of space 9, and through-hole 3*b* is blocked by cover 20 made of insulating synthetic resin. Cover 20 is mounted to housing 3 such that cover 20 closes through-hole 3*b* formed in housing 3. In this embodiment, cover 20 is mounted to housing 3 by moving cover 20 relative to housing 3 from left to right in FIG. 5. Accordingly the direction from the downstream side of air-tunnel 4 to the upstream side is a mounting direction of cover 20 to housing 3. Metal particulate outlets 20*a*, 20*b* and mist outlet 20*c* are formed independently of each other on cover 20.

In front of mist generator 50, and metal particulate generators 30, 40, ion flow path 4*c* is formed, so that metal particulate outlets 20*a*, 20*b*, and mist outlet 20*c* are disposed on a downstream side of ion flow path 4*c*.

Cover 20 is preferably made of the material of lower conductivity than housing 3 in order to prevent cover 20 from being charged due to metal particulates or mist. Because if cover 20 is electrically charged, an electric charge of cover 20 prohibits metal particulate generators 30, 40, and mist generator 50 from supplying charged metal particulates, minus-ion, and mist.

To prevent cover 20 from being electrically charged, cover 20 is preferably made of charge-resistive material such as polycarbonate resin. Cover 20 forms the enclosure of hair dryer 1, although housing 3 forms the other part of the enclosure.

In this embodiment, the hole diameters of metal-particulate outlets 20*a*, 20*b* are smaller than the hole diameter of mist outlet 20*c*. This structure allows maintenance and monitoring works, provided to mist generator 50 through mist outlet 20*c*, to be done with more ease, and also preventing fingers or tools from erroneously entering mist outlet 20*c* through metal particulates outlets 20*a*, 20*b*.

A rib is preferably formed inside cover 20, and is brought into contact with the second electrode, namely, discharge-opposite electrode 52 in order to remove electrostatic from cover 20.

As discussed above, three ion generators are formed (ion generator 100) in this embodiment, to be more specific, cover 20 and mist generator 50, cover 20 and metal particulate generator 30, and cover 20 and metal particulate generator 40 respectively form one ion generator, so that three ion generators in total are formed.

In this embodiment, charge supply panel 1*f* that can change a charged state of hair is disposed near handle 1*a*. To be more specific, charge supply panel 1*f* is formed of conductive resin exposed to an exterior surface of handle 1*a*.

Figure 2:
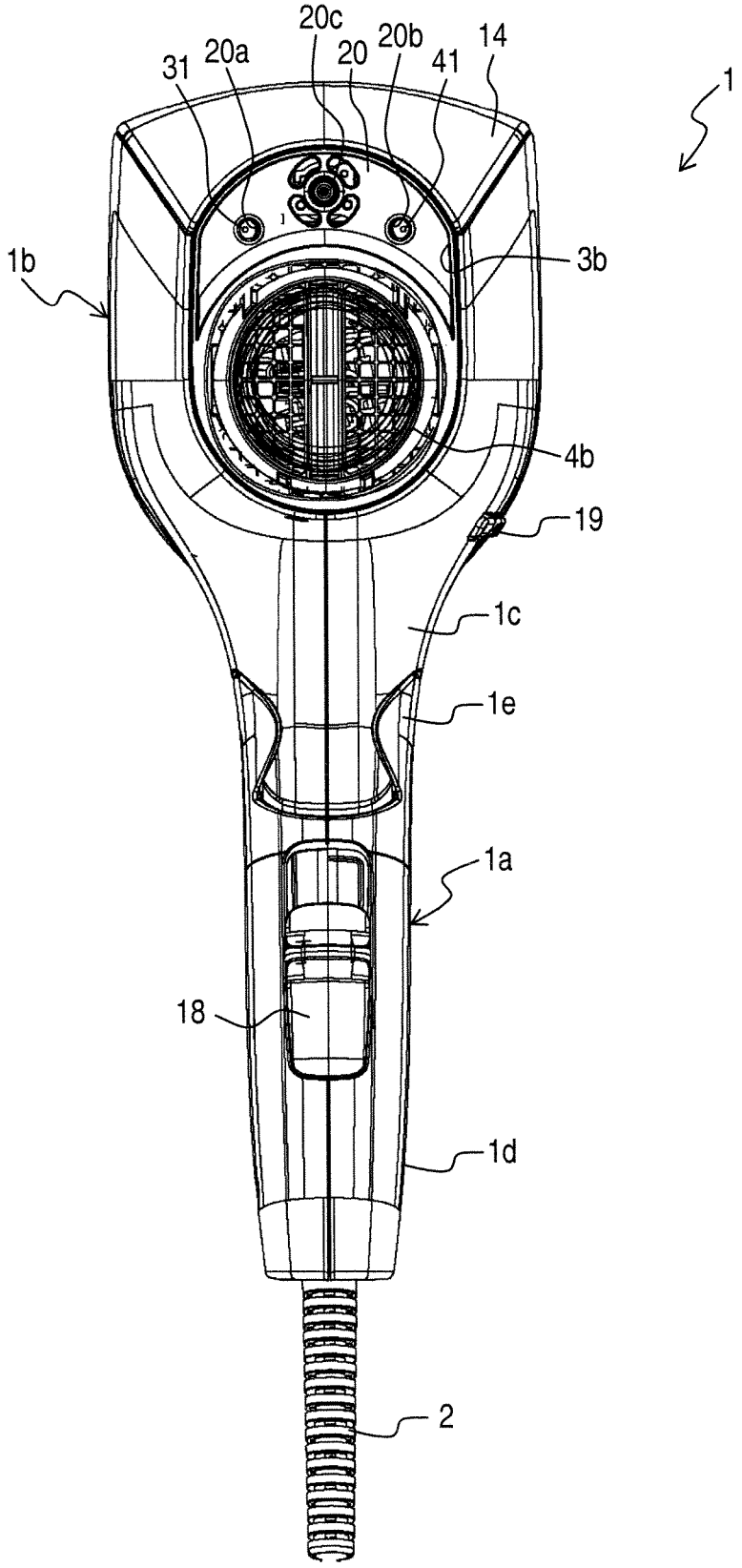
FIG. 2 is a front view of a heating blower in accordance with the embodiment.
Figure 3:
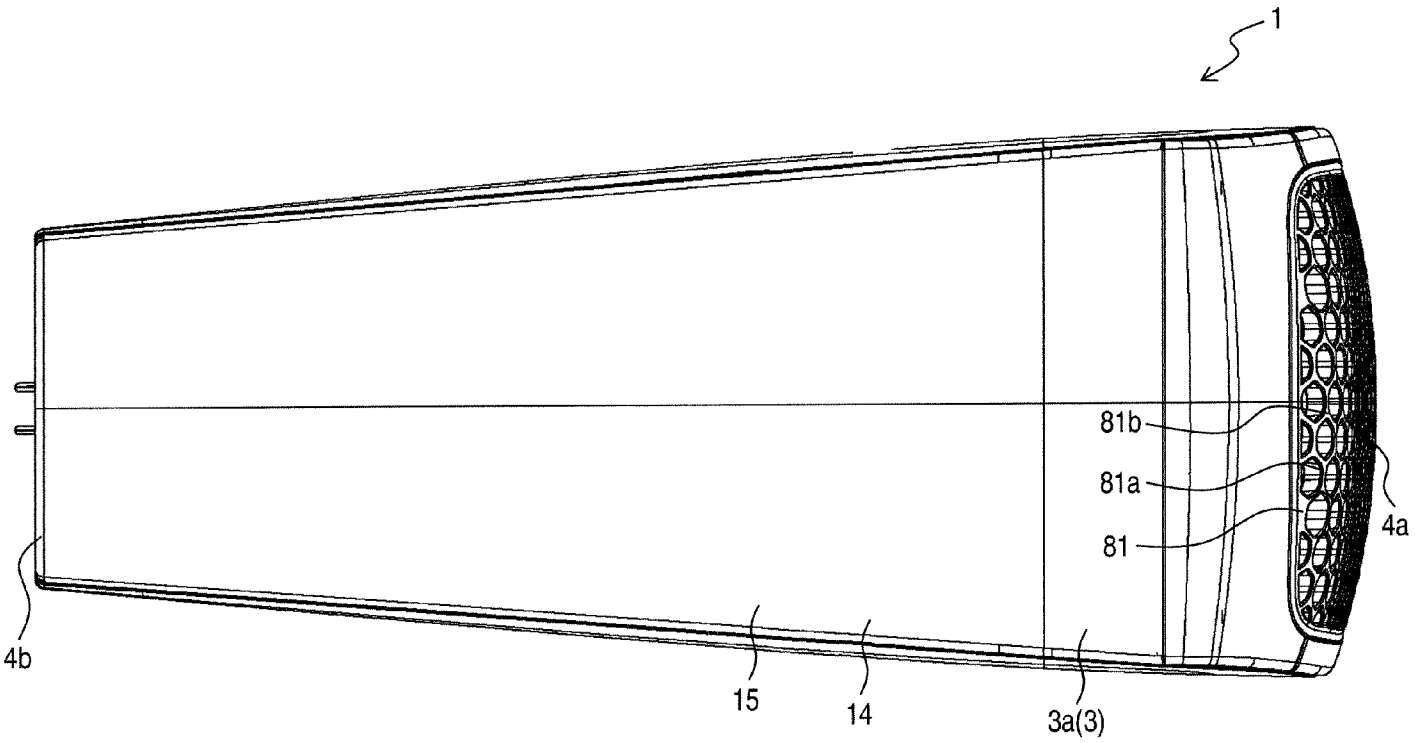
FIG. 3 is a plan view of the heating blower in accordance with the embodiment.
Figure 4:
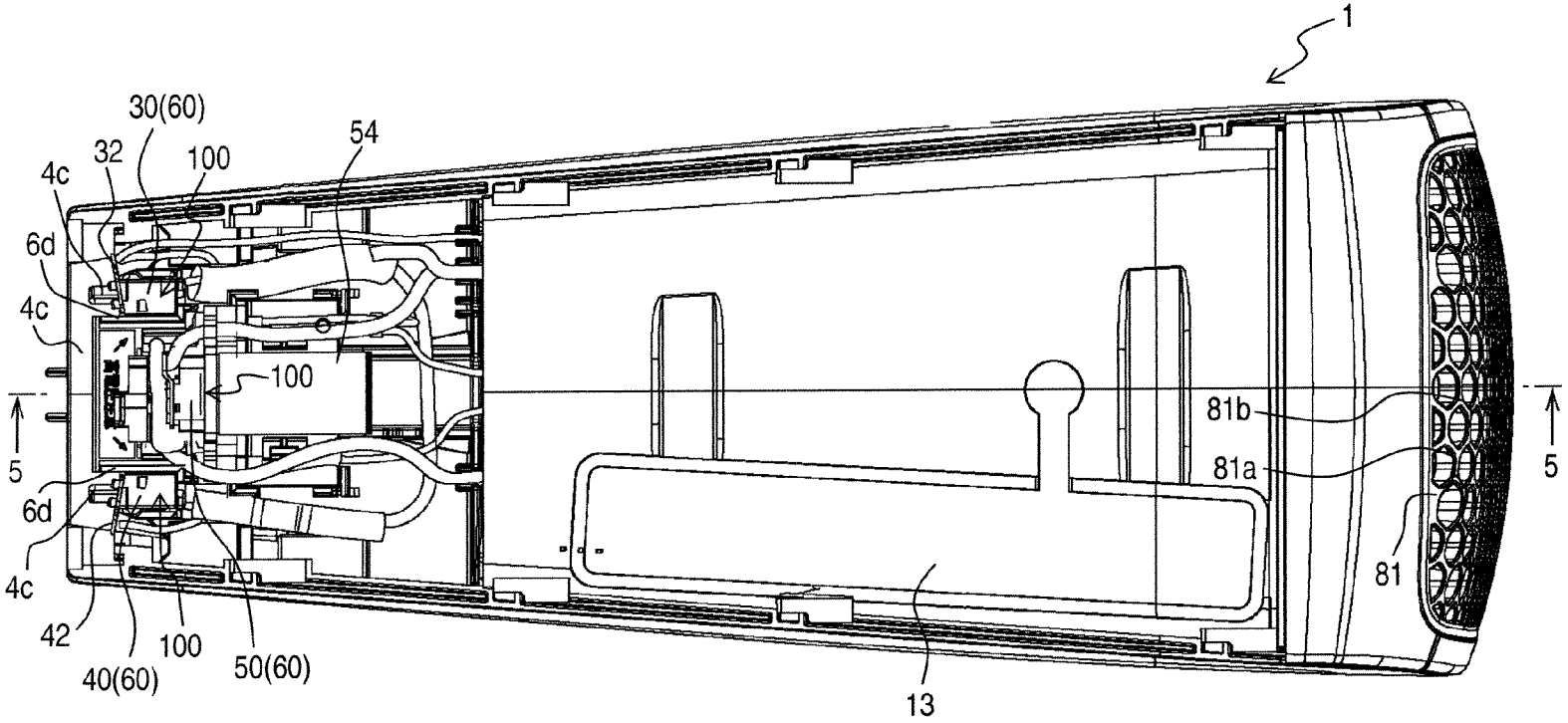
FIG. 4 is a plan view showing an interior of the heating blower in accordance with the embodiment.

In this embodiment, metal particulate outlets 20*a*, 20*b* are formed in the vicinity of mist outlet 20*c*. To be more specific, mist outlet 20*c* is interposed as a center between outlet 20*a* and outlet 20*b*. In other words, metal particulate outlet 20*a*, mist outlet 20*c*, and metal particulate outlet 20*b* are formed on cover 20 in this order along a width direction (left and right direction in FIG. 2). This layout allows minus-ion blown out from outlets 20*a*, 20*b* to prevent negatively charged mist from diffusing outside. As a result, a straightness of the mist is improved, and the mist can reach the hair with more ease, which enhances the effect of hair-care.

Metal particulate generator 30, mist generator 50, and metal particulate generator 40 are formed in this order within space 9 along the width direction of hair dryer 1 (left and right direction in FIG. 2), and shielding plate 6*d* is interposed between mist generator 50 and metal particulate generators 30, 40. As FIG. 6 shows, shielding plate 6*d* extends along the vertical direction of hair dryer 1 and along a mist blow-out direction. This structure allows preventing the metal particulate and the mist from being mixed together before they blow out from the respective outlets.

Metal particulate generators 30, 40 include first electrodes (i.e. discharge electrodes 31, 41) and second electrodes (i.e. discharge-opposite electrodes 32, 42) respectively. A high voltage (from −1 kV to −3 kV) is applied across discharge electrodes 31, 41 and discharge opposite electrodes 32, 42 by a voltage application circuit (not shown) for generating a discharge, such as a corona discharge, which causes discharge electrodes 31, 41 and discharge opposite electrodes 32, 42 to discharge metal particulates (molecule of metal, minus ion). Metal particulate generators 30, 40 can be in a similar shape to each other, or they can be in different shapes.

Metal particulate generators 30, 40 include box-like housings 33, 43. Discharge electrodes 31, 41 are fixed to board 34, 44 at root sections 31*b*, 41*b*. Board 34, 44 serve as a supporting member inside housing 33, 43. Discharge opposite electrodes 32, 42 are supported by housing 33, 43 such that they are placed oppositely to tip sections 31*a*, 41*a* of discharge electrodes 31, 41.

Discharge electrodes 31, 41 can be made of ultra-thin wire of which diameter preferably falls within the range of 10-400 μm, more preferably 30-300 μm, and most preferably 50-200 μm. The wire's cross section may be various shapes including a circle, oval, and polygon.

Discharge electrodes 31, 41 can be made of, for instance, a monolithic transition metal (e.g. gold, silver, copper, platinum, zinc, titanium, rhodium, palladium iridium, ruthenium, or osmium), an alloy of some of these metals, or a plated one of these transition metals. In the case of the discharged metal particulate containing gold, silver, copper, zinc or the like, this metal particulate causes antibacterial action.

In the case of the metal particulate containing platinum, zinc, titanium or the like, the metal particulate causes antibacterial action. It is known that the platinum particulate can cause substantially strong antibacterial action.

In this embodiment, discharge electrode 31 of metal particulate generator 30 contains zinc, and discharge electrode 41 of metal particulate generator 40 also contains zinc; however, electrodes 31, 41 can contain different metals.

Metal particulate generators 30 and 40 produce ion (e.g. minus ion such as NO2−, NO3−) with the aid of discharge action. The ion is hit against discharge electrodes 31, 41, discharge-opposite electrodes 32, 42, or members containing other metal materials or metal components, thereby generating the metal particulate. In other words, discharge-opposite electrodes 32, 42 and the foregoing other members can be formed of materials containing some of the transition metals discussed above, thereby discharging the metal particulates therefrom. Metal particulate generators 30, 40 generate acid component due to the discharge action.

Figure 18:
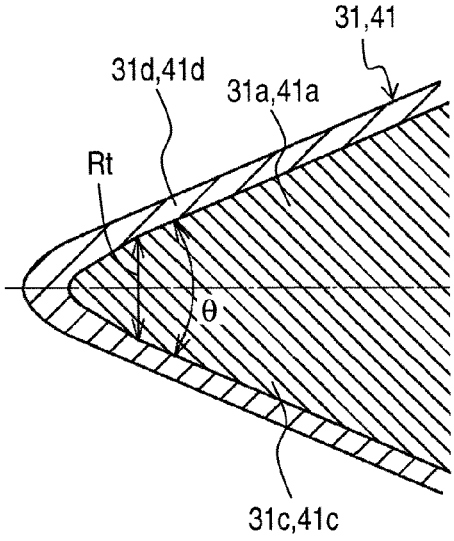
FIG. 18 is a sectional view of another first electrode disposed in the ion generator in accordance with the embodiment.
Figure 19:
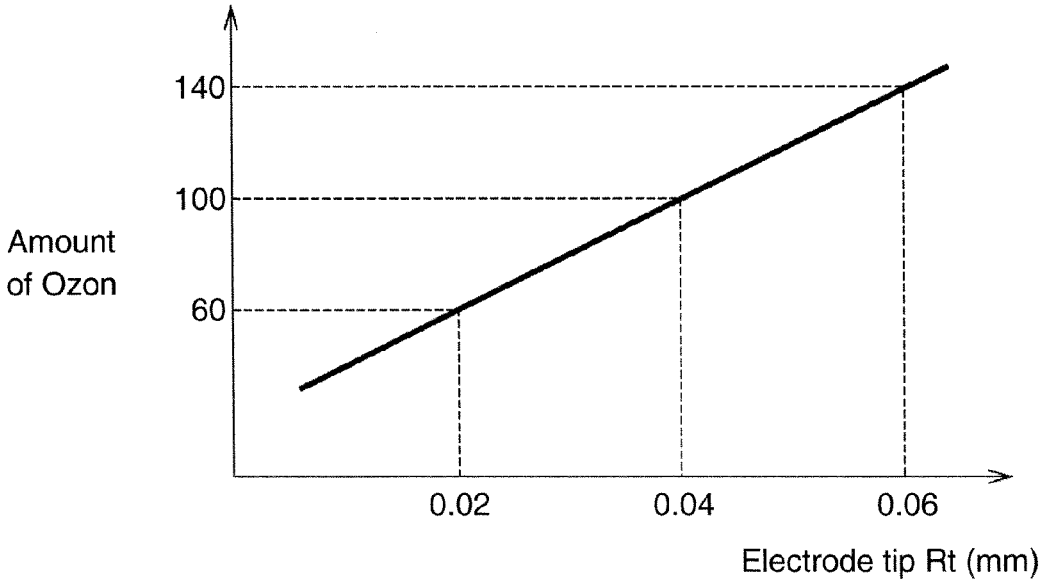
FIG. 19 illustrates a relation between a tip shape of an electrode and a production amount of ozone.

As FIG. 18 shows, base metals 31*c*, 41*c* of transition metal have undergone plating processes 31*d*, 41*d* respectively, and resultant metals constitute discharge electrodes 31, 41. In this case, first electrodes 31, 41 have tips having a lower sharpness, namely, a greater tip Rt allows the discharge to produce a greater amount of ozone (refer to FIG. 19.) To reduce the amount of ozone, the sharpness of the tip of first electrodes 31, 41 should be increased (=higher sharpness), namely, tip Rt should be small. Tip Rt is preferably equal to or smaller than 0.1 mm, and more preferably tip Rt is equal to or smaller than 0.04 mm. In this embodiment, the sharpness of tip Rt is specified by a width of a tip in round shape.

A higher sharpness of each tip of discharge electrodes 31, 41 invites a lower strength of discharge electrodes 31, 41, so that they are deformed with ease by external stress. To avoid this problem, angle θ of each tip of discharge electrodes 31, 41 is preferably as large as possible under the condition in which a charging state stays steadily. To be more specific, angle θ preferably falls within a range of 40-50°. Then the strength of discharge electrodes 31, 41 can be increased.

In the case of using members 31*d* and 41*d*, which have undergone a plating process on base metal of transition metal, as discharge electrodes 31 and 41, the base metal preferably employs a material of higher hardness, such as a hard steel wire or piano wire. Use of such a material allows preventing discharge electrodes 31, 41 from deforming.

Mist generator 50 includes a first electrode (i.e. discharge electrode 51), made of conductive metal material, and a second electrode (i.e. discharge-opposite electrode 52). A high voltage (from −3 kV to −5 kV) is applied across discharge electrodes 51 and discharge opposite electrodes 52 by voltage application circuit 12 for generating a discharge, such as a corona discharge. In this embodiment, discharge electrode 51 shapes like a needle, and discharge-opposite electrode 52 shapes like a plate and is disposed on discharge electrode 51 side with a space therebetween.

Discharge-opposite electrode 52 includes plate-like base section 52*a*, and opening 52*c* is formed at approx. center of base section 52*a*. Opening 52*c* is an exit port of the metal particulate. Discharge electrode 51 is disposed almost at the center of opening 52*c* viewed from the front.

An electrostatic atomizer is used as mist generator 50. This atomizer includes cooling section 53 for cooling discharge electrode 51, heat-dissipating fin 54 for dissipating heat produced during the cooling of discharge electrode 51 by cooling section 53.

To be more specific, mist generator 50 includes Peltier element 53*a* working as cooling section 53, and cooling plate 53*b* made of, for instance, conductive metal material. Water in the air is condensed on cooling plate 53*b* that is cooled by Peltier element 53*a*, thereby producing dew water.

On an upstream side of mist generator 50, heat dissipating fin 54 are disposed for dissipating heat produced during the cooling of cooling plate 53*b*. This structure allows the discharge action to atomize the dew water, thereby generating ultra-fine mist on the order of nanometer. This mist contains minus ion and is charged in minus, namely, this mist is a charged particulate liquid. Mist generator 50 allows the charge action to generate ion and acid component as well.

Metal particulate generators 30, 40 and mist generator 50 are placed on fixing member 6*g* provided above upper wall 6*f* of inner cylinder 6, whereby those structural elements are fixed above inner cylinder 6. Mist generator 50 includes mounting plate 55 at a lower section of heat dissipating fin 54, and this mounting plate 55 is mounted to mounting member 6*g*, so that mist generator 50 is fixed above inner cylinder 6.

The shape and location of fixing member 6*g* can be set in various ways so that the air flowing in space 9 can be changed desirably in direction and in amount. In other words, fixing member 6*g* can be used as a control means for controlling the direction and amount of air flowing in space 9.

In this embodiment, discharge-opposite electrode 52 is disposed closer to mist outlet 20*c* than discharge electrode 51, and opening 52*c* is provided to discharge-opposite electrode 52. Opening 52*c* is not necessarily disposed at the center of discharge-opposite electrode 52, and it can be deviated from the tip of discharge electrode 51 viewed from the front, or it may slant.

The area of opening 52*c* of discharge-opposite electrode 52 is preferably equal to or greater than 7 $mm^2$ in order to reduce static electricity on hair. In this embodiment, opening 52*c* being 4 mm across is formed. A rim section of opening

52*c* is shaped like a dome protruding oppositely to discharge electrode 51. This rim section can be formed, for instance, in this way: Punch an opening on thin plate having a thickness of 0.5 mm, and bend a rim of this opening to one side.

In this embodiment, an amount of the component can be adjusted to fit to a dry state of hair. To be more specific, controller 10 controls an amount of the component generated by generator 60. For instance, an excessive supply of the ion to dried hair incurs excessive electric charges on the surface of the dried hair, whereby a bind-up of the hair or a run of fingers through the hair cannot be done well. An excessive supply of the acid component to the dried hair prompts the cuticle to be excessively tightened, so that the hair is excessively shrunk and curled. As a result, the hair becomes hard to reform, or unpleasant to touch.

An excessive supply of the charged particulate liquid to the dried hair causes the hair to be excessively wet and become sticky.

To overcome these problems, in this embodiment controller 10 reduces an amount of the component generated by generator 60 when a given time has passed from the operation start, or with a lapse of time. This control sequence is exemplified hereinafter.

Figure 8:
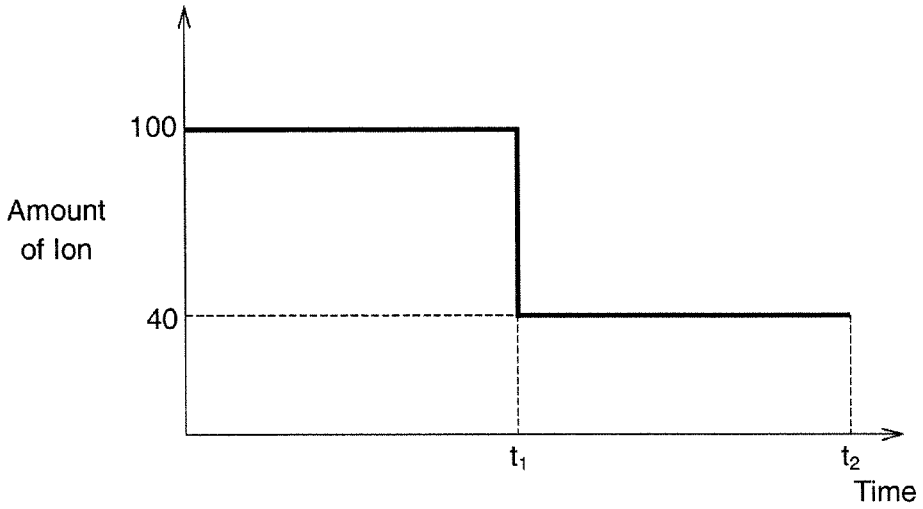
FIG. 8 shows a control sequence that indicates changes in production amount of ion with the laps of time.

FIG. 8 shows changes in production amount of ion with a lapse of time. The control sequence shown in FIG. 8 produces a given amount of ion from the operation start until predetermined time t1, and starts reducing the amount at predetermined time t1. After time t1 until at least another predetermined time t2, the reduced amount is maintained. Assume that the initial production amount is 100, then this control sequence controls such that the reduced amount is maintained at 40. This reduction ratio can be set appropriately.

A specific control sequence method for controlling a produced amount of ion, acid component, and charged particulate liquid includes, for instance, a method of changing a shape of the second electrode, a method of changing a distance between the first electrode and the second electrode, or a method of changing a discharge-current by changing a high-voltage to be applied across the first electrode and the second electrode.

The control sequence shown in FIG. 8 is applicable as well to the acid component generator, the charged particulate liquid generator. The control sequences shown in FIGS. 9, 10, 14-16 are also applicable to them.

Figure 9:
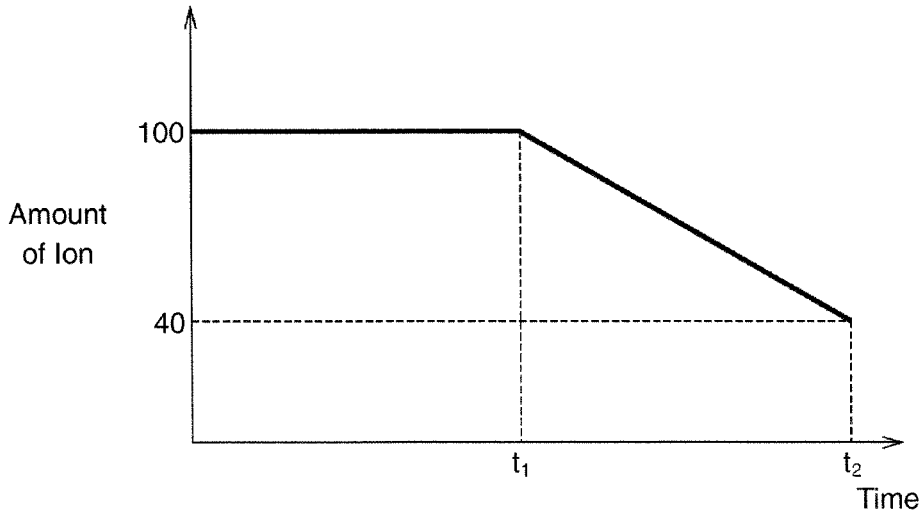
FIG. 9 shows a control sequence that indicates changes in production amount of ion with the laps of time.

FIG. 9 shows changes in the production amount of ion with a lapse of time. This control sequence produces a given amount of ion from the operation start until predetermined time t1, then reduces the amount gradually after time 1 until predetermined time t2. For instance, this control sequence sets an initial production amount to 100, and then reduces the amount eventually to 40.

The control sequences shown in FIGS. 8 and 9 reduce the amount of ion produced by generator 60 in a predetermined time after the operation start.

Figure 10:
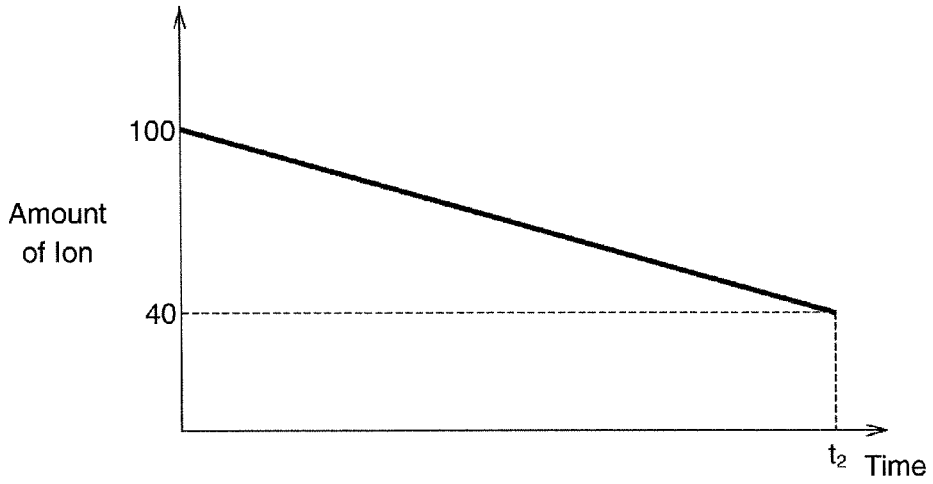
FIG. 10 shows a control sequence that indicates changes in production amount of ion with the laps of time.

FIG. 10 shows changes in production amount of ion with a lapse of time. This control sequence reduces gradually the production amount of ion from the operation start of generator 60 until predetermined time t2. This control sequence also sets, for instance, an initial production amount to 100, and then reduces the amount eventually to 40.

These control sequences allow supplying ion in an amount adequate to a degree of dried hair. However, the state of hair is different depending on individuals, for instance, a person has thick hair and another person has thin hair. If the same amount of ion is supplied to every user, some users possibly cannot get suitable hair-care effect, because individuals have different impressions about the suitable hair-care effect.

To overcome this problem, the amount of component produced by generator 60 can be changed in response to a selected control mode. To be more specific, two control modes are prepared. A first control mode sets a production amount of at least one component produced by generator 60 to a given amount, and a second control mode sets a production amount smaller than the production amount set by the first control mode.

Figure 11:
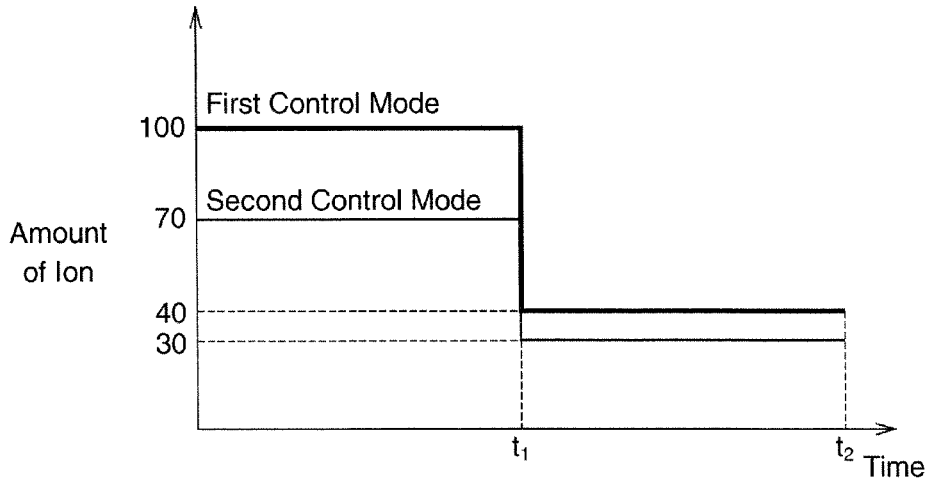
FIG. 11 shows a control sequence that indicates changes in production amount of ion for each hair-nature mode with the laps of time.

FIG. 11 illustrates control sequences for each of hair-nature modes, and shows changes in production amounts of ion with a lapse of time. In this case, generator 60 produces ion. As FIG. 11 shows, a selection of the first control mode prompts generator 60 to produce a given amount of ion from the operation start until predetermined time t1, and then after the predetermined time t1, to reduce the given amount. In this case, an initial production amount is set to 100, and an eventual production amount after the reduction is set to 40, which is maintained until at least predetermined time t2.

A selection of the second control mode prompts generator 60 to produce a given amount of ion from the operation start until predetermined time t1, and then after the predetermined time t1, to reduce the given amount. In this case, an initial production amount is set to 70, and an eventual production amount after the reduction is set to 30, which is maintained until at least predetermined time t2.

Figure 12:
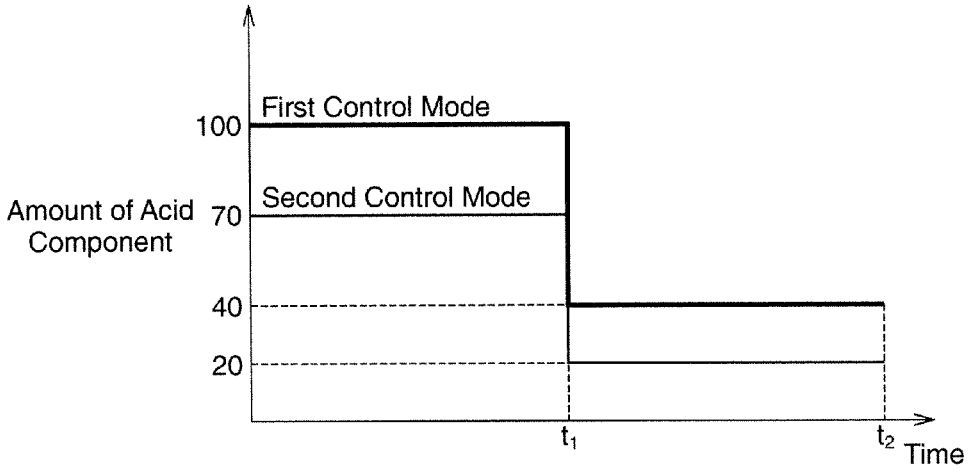
FIG. 12 shows a control sequence that indicates changes in production amount of acid component for each hair-nature mode with the laps of time.

FIG. 12 illustrates control sequences for each of hair-nature mode, and shows changes in production amounts of acid component with a lapse of time. In this case, generator 60 produces acid component. As FIG. 12 shows, a selection of the first control mode prompts generator 60 to produce a given amount of acid component from the operation start until predetermined time t1, and then after the predetermined time t1, to reduce the given amount. In this case, an initial production amount is set to 100, and an eventual production amount after the reduction is set to 40, which is maintained until at least predetermined time t2.

A selection of the second control mode prompts generator 60 to produce a given amount of acid component from the operation start until predetermined time t1, and then after the predetermined time t1, to reduce the given amount. In this case, an initial amount is set to 70, and an eventual amount after the reduction is set to 20, which is maintained until at least predetermined time t2.

Figure 13:
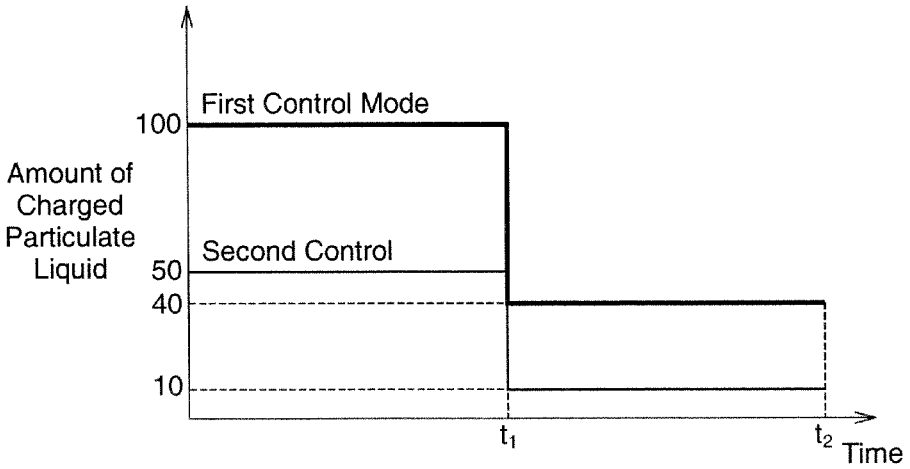
FIG. 13 shows a control sequence that indicates changes in production amount of charged particulate liquid for each hear-nature mode with the laps of time.

FIG. 13 illustrates control sequences for each of hair-nature modes, and shows changes in production amounts of charged particulate liquid with a lapse of time. In this case, generator 60 produces charged particulate liquid. As FIG. 13 shows, a selection of the first control mode prompts generator 60 to produce a given amount of charged particulate liquid from the operation start until predetermined time t1, and then after the predetermined time t1, to reduce the given amount. In this case, an initial production amount is set to 100, and an eventual production amount after the reduction is set to 40, which is kept until at least predetermined time t2.

A selection of the second control mode prompts generator 60 to produce a given amount of charged particulate liquid from the operation start until predetermined time t1, and then after the predetermined time t1, to reduce the given amount. In this case, an initial production amount is set to 70, and an eventual production amount after the reduction is set to 10, which is kept until at least predetermined time t2.

The ratio of the initial production amount vs. the eventual production amount in the second control mode can be the same as that in the first control mode, or as described above, the ratio can be different from that in the first control mode for each component. The initial production amount in the first control mode can be the same as that in the second production amount as discussed above, or they can be different for each component. In other words, the production amount of each component can be set more adequately depending on hairs different in length or degree of dry state.

The ratio of the initial production amount in the first control mode vs. that in the second control mode can be set appropriately for each component. The ratio of the initial production amount vs. the eventual production amount in each control mode can be set appropriately to each component.

The control sequences shown in FIG. 9 or FIG. 10 can be used as the two control modes for each component. The first control mode can employ a control sequence different from a control sequence of the second control mode.

As discussed above, this embodiment proves that an operation of switch 19*a* allows a user to select one of two hair-nature modes, namely, a thick-hair mode that is chiefly selected by users having thick hairs or a thin-hair mode that is chiefly selected by users having thin hairs. In the case of selecting the thick-hair mode, the first control mode is used to produce a greater amount, and in the case of selecting the thin-hair mode, the second control mode is to produce a smaller amount. In this embodiment, the operation of switch 19*a* allows switching the hair-nature modes, thereby changing the production amount by generator 60.

For instance, when a user having thick hair selects the thick-hair mode so that the first control mode producing a greater amount of component can be used. This selection allows supplying the thick hair hard to be bound up with an adequate amount of component and in response to a degree of dry state of the hair. The hair-care effect thus can be improved.

On the other hand, when a user having thin hair selects the thin-hair mode so that the second control mode producing a smaller amount of component can be used. This selection allows supplying the thin hair hard to appear bulky with an adequate amount of component and in response to a degree of dry state of the hair. The hair-care effect thus can be improved.

When there are two kinds of hairs of the same hair nature, but their lengths differ from each other, then the two kinds of hairs are blown by hair dryer 1 for the same period of time, whereby the two kinds of hairs are dried to different degrees of dry state from each other. To overcome this problem, the predetermined time until the amount of component starts decreasing can be changed in response to a length of hair.

In this embodiment, an operation of switch 19*b* allows switching hair-length modes. Three types of hair-length modes are available in this embodiment, namely, a short-hair mode to be selected chiefly by users having short hairs, a long-hair mode to be selected chiefly by users having long hairs, and a medium-hair mode to be selected chiefly by users having medium length hairs.

Controller 10 performs control such that a predetermined time until a decrease in a production amount of component starts can be changed. To be more specific, the long hairs need a longer time to be dried, so that a selection of the long-hair mode prompts controller 60 to set the predetermined time, until a decrease in a production amount of component starts, to a longer time.

Figure 14:
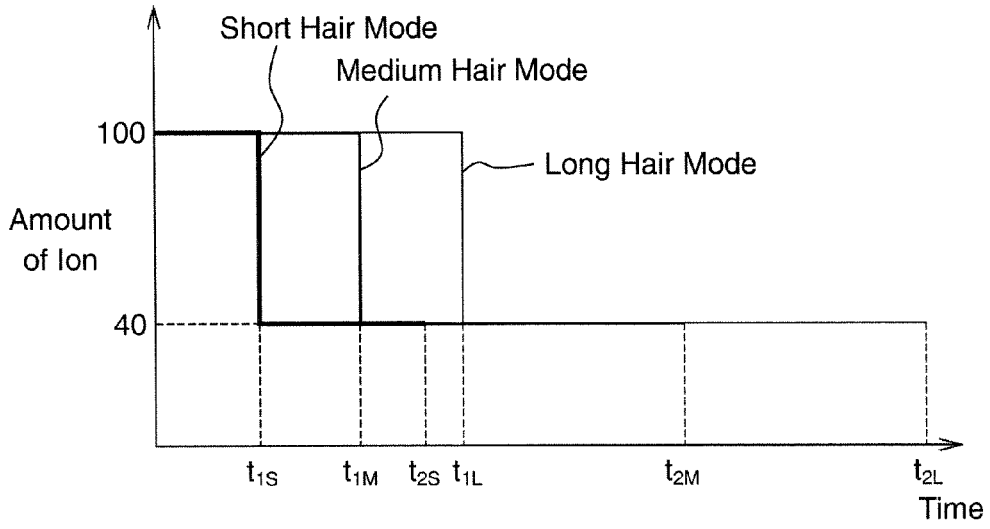
FIG. 14 shows a control sequence that indicates changes in production amount of for each hair-length mode with the laps of time.

FIG. 14 shows control sequences for each one of hair-length modes. As FIG. 14 illustrates, from the operation start of controller 60 until just after predetermined time t1L passes, a given amount of component is produced, and the amount starts decreasing after time t1L. The initial production amount is set to 100, and the eventual amount after the decrease is set to 40, which is maintained until at least predetermined time t2L, at which generator 60 stops operating.

The short hairs need a shorter time to be dried, so that a selection of the short-hair mode prompts controller 60 to set the predetermined time, until a decrease in a production amount of component starts, to a shorter time.

As FIG. 14 illustrates, from the operation start of controller 60 to just after predetermined time t1S, a given amount of component is produced, and the amount starts decreasing after time t1S. The initial production amount is set to 100, and the eventual amount after the decrease is set to 40, which is maintained until at least predetermined time t2S, at which generator 60 stops operating.

The medium-length hairs need a medium length of time to be dried, so that a selection of the medium-length hair mode prompts controller 60 to set the predetermined time, until a decrease in a production amount of component starts, to a medium length of time between the time for the short-hair mode and the long-hair mode.

As FIG. 14 illustrates, from the operation start of controller 60 until just after predetermined time t1M passes, a given amount of component is produced, and the amount starts decreasing after time t1M. The initial production amount is set to 100, and the eventual amount after the decrease is set to 40, which is maintained until at least predetermined time t2M, at which generator 60 stops operating.

As FIG. 14 shows, predetermined times t1S, t1M, and t1L, until the production amount starts decreasing, are in the relation of $t1S<t1M<t1L$. The operation stop times of controller 60 are t2S, t2M, and t2L, and they are in the relation of $t2S<t2M<t2L$. The time durations from the starts of decrease in production amount to the operation stops of generator 60 are $t2S-t1S$, $t2M-t1M$, $t2L-t1L$, and they are in the relation of $t2S-t1S<t2M-t1M<t2L-t1L$.

The foregoing control sequences allow a user to operate switch 19*b* to select one of the hair-length modes while the user considers, for instance, hair length, thickness, volume, a degree of damage and the like, and allows the user to determine a drying time. A desirable hair-care effect can be thus given to the hair.

When the user determines a time for supplying the hair with a greater amount of component, a mode corresponding to this determined time can be selected. For instance, in the case of short hair requiring a shorter drying time, it is preferable to change an amount of component at least in 30 seconds and at longest in 1.5 minutes, more preferably in approx. 1 (one) minute.

In the case of medium-length hair requiring a medium-length of time, it is preferable to change an amount of component at least in 1.5 minutes and at longest in 3 minutes, more preferably in approx. 2 minutes.

In the case of long hairs requiring a longer time, it is preferable to change an amount of component at least in 2 minutes and at longest in 5 minutes, more preferably in approx. 3 minutes.

In the case of decreasing the amount of component with the lapse of time, a decreasing rate of component per unit time can be changed.

Figure 15:
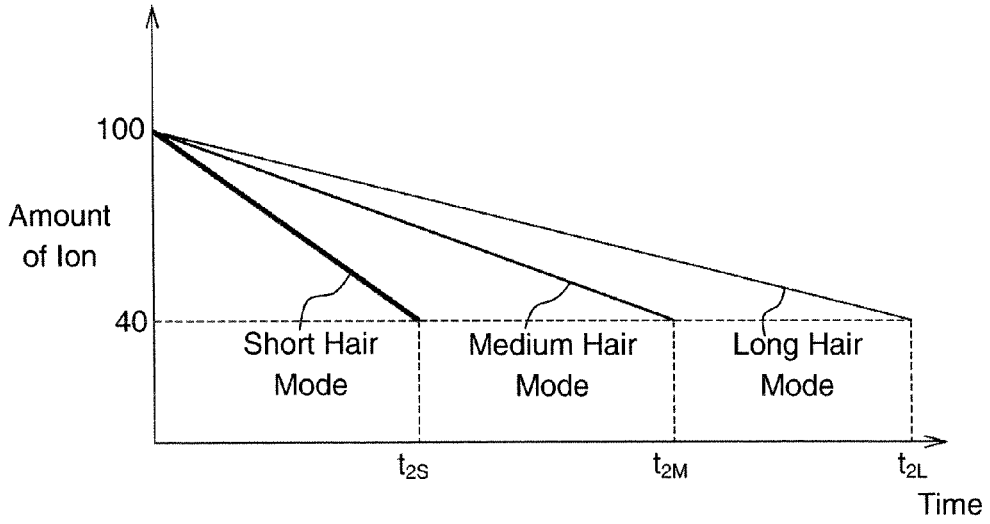
FIG. 15 shows a control sequence that indicates changes in production amount of for each hair-length mode with the laps of time.

FIG. 15 shows the control sequences for each hair-mode used in the case where the production amount of ion starts decreasing, after the predetermined time has passed, with a laps of time. As FIG. 15 illustrates, in the case of the short hair, the initial production amount 100 decreases gradually to 40 until predetermined time t2S. In the case of the medium-length hair, the initial production amount 100 decreases gradually to 40 until predetermined time t2M. In the case of the long hair, the initial production amount 100 decreases gradually to 40 until predetermined time t2L.

This embodiment proves that two hair-nature modes and three hair-length modes can be selected independently of each other, so that six types of control sequences are available for an appropriate selection.

This embodiment shows control sequences that can change the production amount with a lapse of time; however, here is another method, for instance, the production amount can be changed depending on a water content in hair. This water content is measured with a non-contact type infrared sensor or contact-type sensor.

Figure 16:
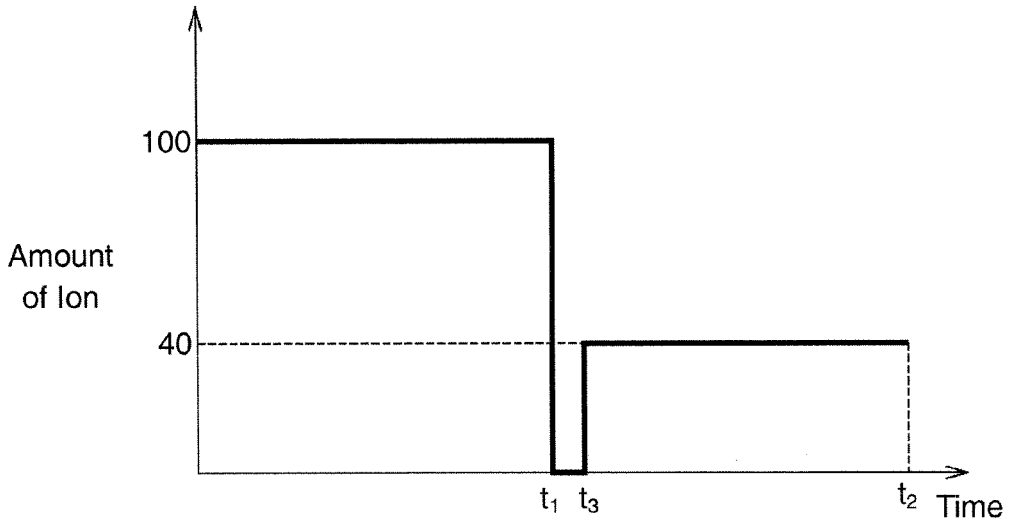
FIG. 16 shows a control sequence that removes electric charges from the generator.
Figure 17:
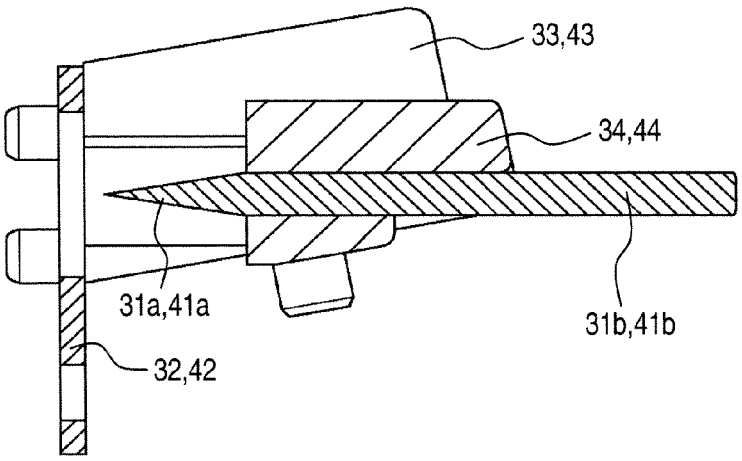
FIG. 17 is a sectional view of an ion generator in accordance with the embodiment.

Before a production amount of at least one of the components is decreased, production of all the components can be halted for a predetermined time. To be more specific, as FIG. 16 shows, a constant amount of component is produced from the operation start until predetermined time t1, then after time t1, the production is temporarily halted, and after predetermined time t3, the production starts again with an amount of 40 relative to an initial production amount of 100. The production amount of 40 is maintained until at least predetermined time t2. This temporary production-halt allows removing electric charges from the surroundings of the generator. In this case, the production amount can be decreased gradually, or it can be increased gradually when the production starts again.

Charge supply panel 1*f* that can change a charged state of hair is disposed near handle 1*a* as discussed previously. A charged amount on charge supply panel 1*f* can be controlled. When a user holds handle 1*a*, this control allows changing the charged state of the hair, so that an amount of ion, acid component, or charged particulate liquid to be attached to the hair can be changed.

Several ways of changing the charged state of hair are available. For instance, a charged state is changed to another charged state after a lapse of a predetermined time, a charged state is changed with a lapse of time after a predetermined time passes, or a charged state is changed with a lapse of time just after the production start. The first control mode by which a greater amount of ion is produced can have a charged state different from that in the second control mode by which a smaller amount of ion is produced.

As discussed above, a change in charged state of hair allows changing an amount of ion, acid component, or charged particulate liquid to be attached to the hair. As a result, the components can be readily attached to the hair, or they can be resistively attached to the hair. A desirable hair-care effect can be thus given to users' hairs.

Hair dryer 1 in accordance with this embodiment, as discussed above, includes housing 3, fan 5, heater 8, generator 60, and controller 10. Housing 3 forms the enclosure, and includes blowing path 4 disposed inside housing 3 and running from inlet opening 4*a* to outlet opening 4*b*. Fan 5 is disposed inside housing 3 at inlet opening 4*a* side for generating an airflow in blowing path 4. Heater 8 is disposed inside housing 3 at output opening 4*b* side for heating the airflow. Generator 60 is disposed inside housing 3 for supplying the generated component to the airflow. Controller 10 controls an amount of the component generated by generator 60.

Generator 60 includes at least one of the ion generator, acid component generator, and charged particulate liquid generator. Controller 10 controls the amount of component produced by generator 60 such that the amount decreases after a lapse of predetermined time or with a lapse of time from the operation start of generator 60.

The embodiment proves that a production amount of component can be adjusted in response to a dry state of hair, so that a more adequate amount of the component can be supplied to the hair.

Controller 10 can include a first control mode that sets an amount of at least one component out of the components produced by generator 60 to a given amount, and a second control mode that sets an amount of at least one component out of the components produced by generator 60 to an amount smaller than the amount set by the first control mode.

The embodiment introduces a first control mode in which an amount of at least one of ion, acid component, and charged particulate liquid is greater than amounts of the remaining components, and a second control mode in which an amount of at least one of ion, acid component, and charge particulate liquid is smaller than amounts of the remaining components. Each of those two control modes is used for thick hair or thin hair. As a result, the first control mode allows finishing the thick hair wet and readily bound-up, and the second control mode allows finishing the thin hair more soft.

Controller 10 can perform control such that the production is halted for a given time before an amount of at least one of the components produced by generator 60 is reduced.

This embodiment proves that electric charges can be removed from around at least one of the ion generator, acid component generator, and the charged particulate liquid generator. As a result, after the operation is halted for a given time, and at the restart of production of at least one of ion, acid component, and charge particulate liquid, a production amount of the component can be stable.

In the case of generator 60 including the ion generator, a reduction in the production amount of ion in response to a dry state of hair allows preventing excessive electric charges on the surface of the dried hair, so that the hair can be bound up more readily and fingers can run through the hair more easily.

In the case of generator 60 including the acid component generator, a reduction in the production amount of the acid component in response to a dry state of hairs allows preventing excessive shrinkage caused by the acid component on the hair surface, so that an extension of hair-curl can be improved or the hair becomes more pleasant to the touch.

In the case of generator 60 including the charged particulate liquid generator, a reduction in the production amount of the charged particulate liquid in response to a dry state of hairs allows reducing the wet in the hair appropriately, and finishing the hair soft and silky.

Charge supply panel 1*f* that can change an electrically charged state of hair is disposed near handle 1*a*, so that controller 10 can control an electric-charged amount of charge supply panel 1*f*. This structure allows controlling an electric-charge to a user who holds charge supply panel 1*f*. As a result, an amount of at least one of ion, acid component, and charged particulate liquid can be attached steadily to the hair.

Hair dryer 1 further includes display section 14, on which an operating state of at least one of the ion generator, acid component generator, and charged particulate liquid generator, and/or a selected mode can be displayed. This structure allows the user to readily recognize at least one of the selected mode and the operating state.

The preferred embodiment of the present disclosure is discussed above; however, the present disclosure is not limited to this embodiment, and a variety of modifications are available to the present disclosure.

Figure 20:
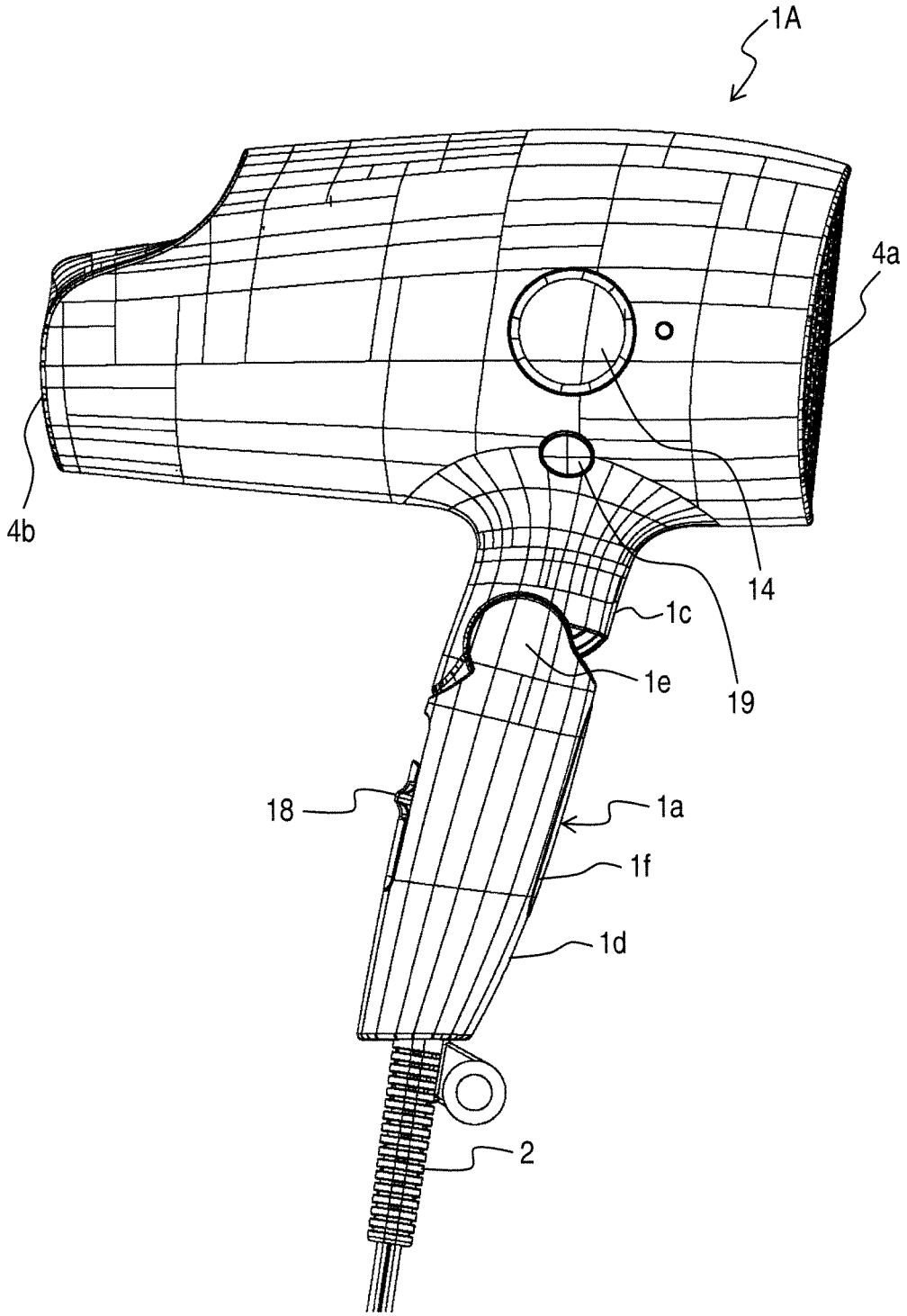
FIG. 20 is a lateral view of a heating blower of a first modification in accordance with the embodiment.
Figure 21:
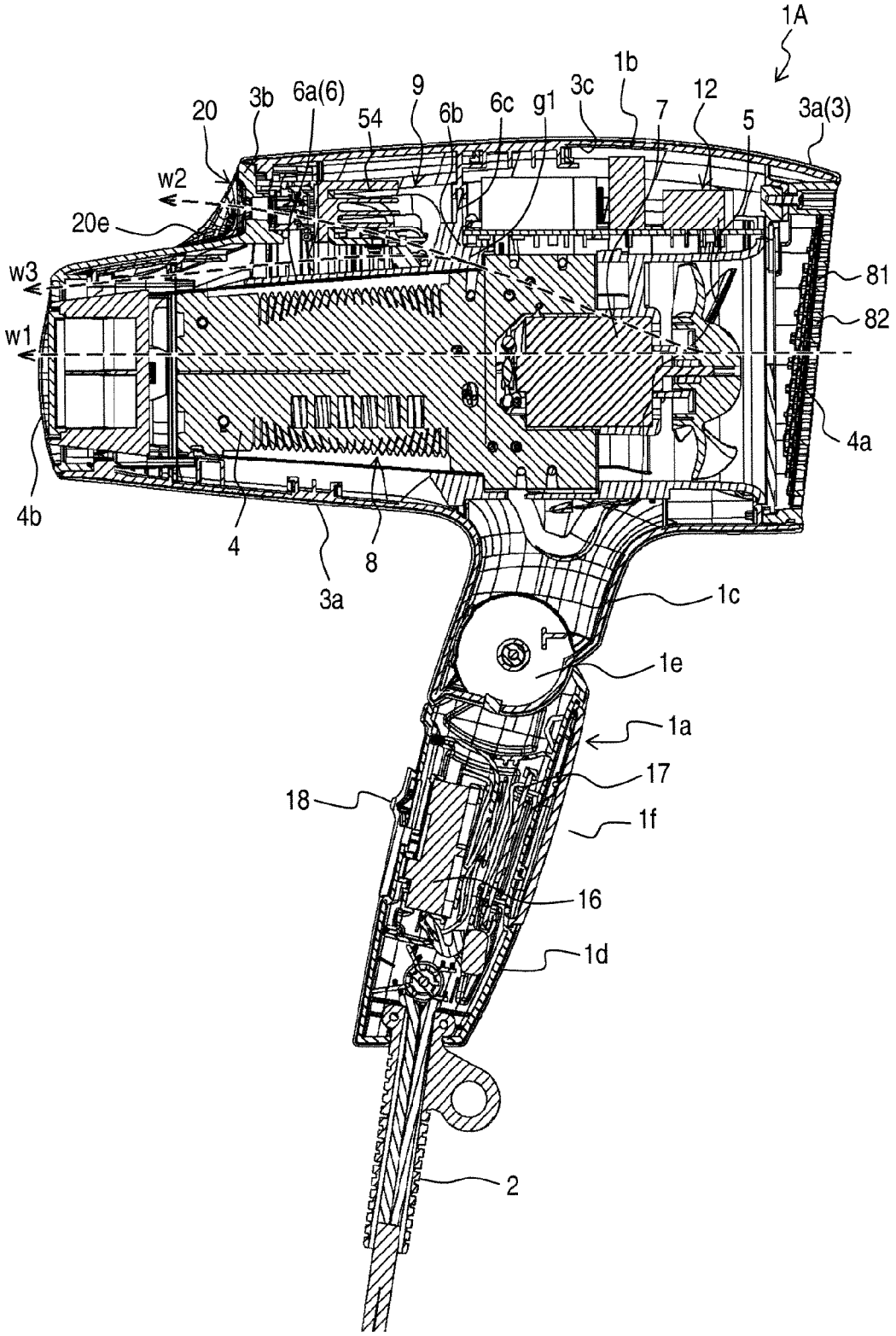
FIG. 21 is a sectional view of the heating blower of the first modification in accordance with the embodiment.
Figure 22:
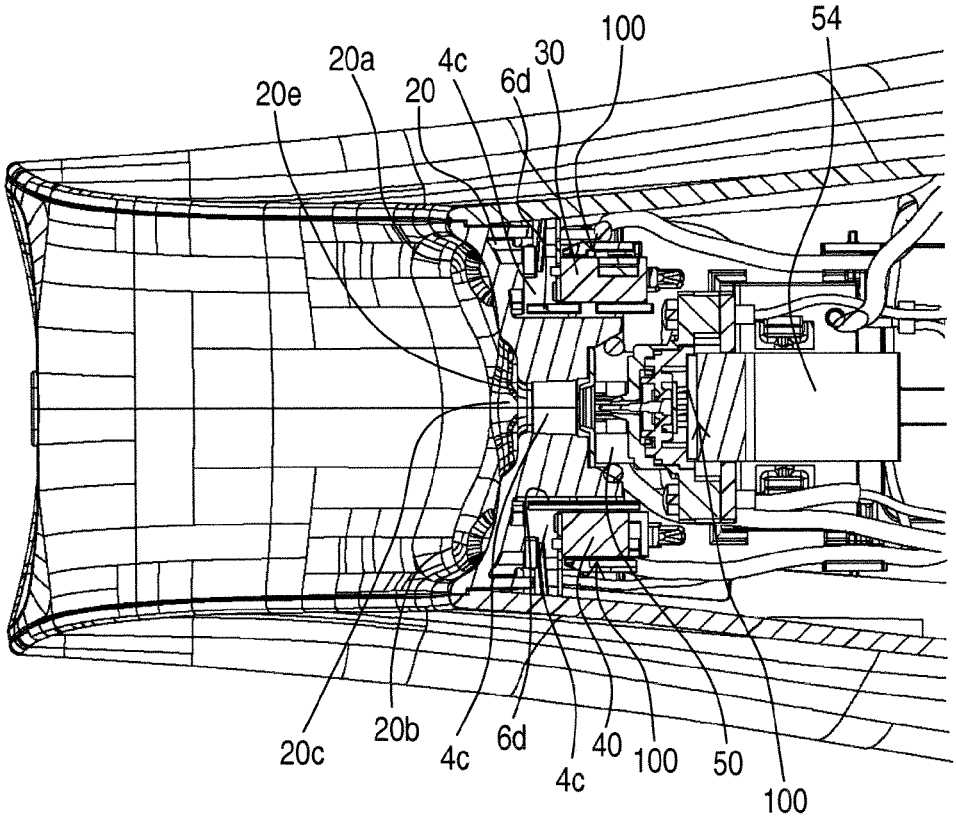
FIG. 22 is a partially enlarged plan view of the heating blower of the first modification in accordance with the embodiment.

For instance, the present disclosure is applicable to hair dryer 1A shown in FIG. 20-FIG. 22, which are a lateral view, sectional view and a partially enlarged plan view of hair dryer 1A. FIG. 22 shows an enlarged portion where a mist generator is disposed. Hair dryer 1A includes two (multiple) metal particulate generators 30, 40 and one mist generator 50 in space 9 formed in main body 1*b* between housing 3 and inner cylinder 6.

In hair dryer 1A, wall 20*e* is disposed on a downstream side of and below mist blow-out port 20*c* such that wall 20*e* extends along a mist blowing-out direction. The presence of wall 20*e* prevents the mist blown out from port 20*c* from diffusing downward. Hair dryer 1A discussed above produces actions and advantages similar to what has been discussed in this embodiment.

Figure 23:
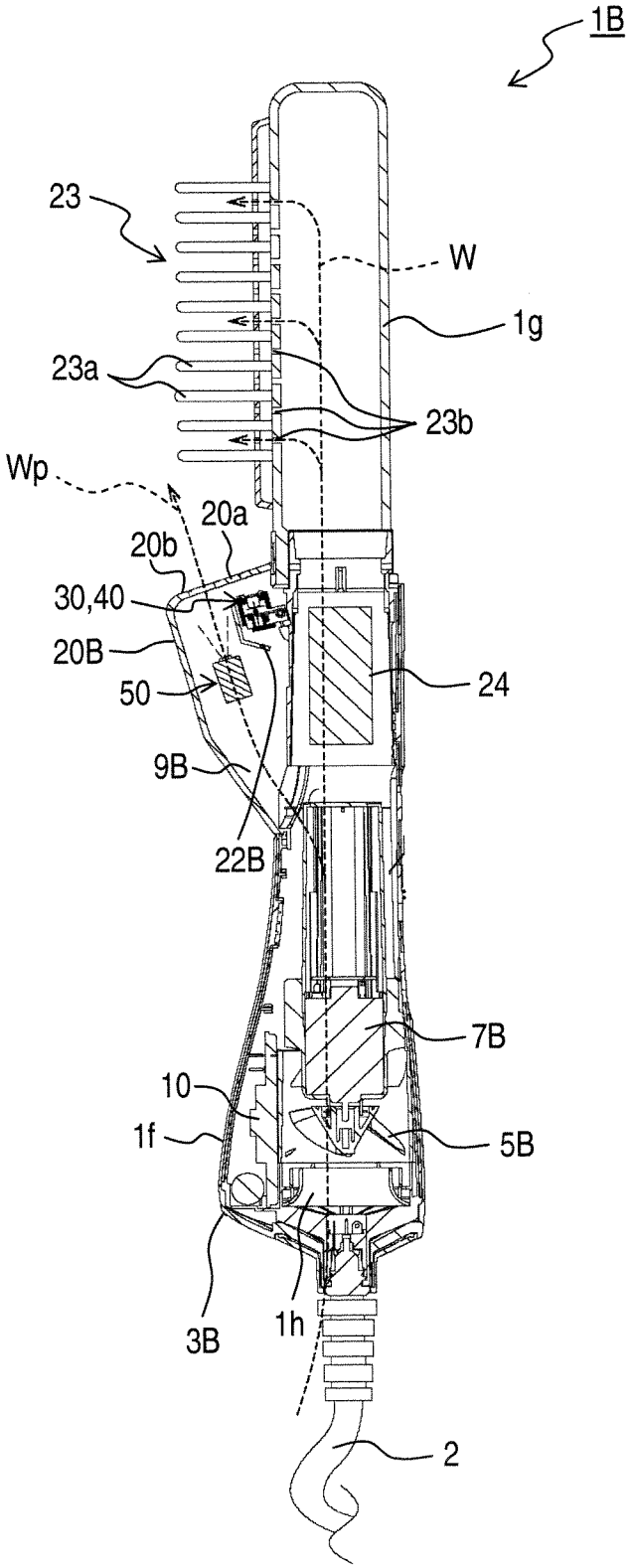
FIG. 23 is a sectional view of a heating blower of a second modification in accordance with the embodiment.

FIG. 23 is a sectional view of hair dryer 1B with a brush in accordance with a second modification of the embodiment. The present disclosure is applicable to hair dryer 1B coming with a brush. Hair dryer 1B is shaped like a stick of which end portion 1*g* includes brush 23. A user combs the hairs with brush 23 while holding handle 1*a*. Multiple projecting bristles 23*a* are mounted to brush 23.

Housing 3B constituting an enclosure is formed by joining multiple split pieces together. Inside housing 3B, air tunnel 9B working as an airflow path is formed, and various electric components are accommodated in air tunnel 9B.

Cover 20 is mounted near brush 23 of handle 1*a* to cover a bulging out portion of the enclosure. Cover 20 and housing 3 form air tunnel 9B that accommodates metal particulate generators 30, 40 and mist generator 50.

Cover 20B includes discharge ports 20*a*, 20*b* open toward bristles 23*a*. Metal particulates produced by metal particulate generators 30, 40 and mist produced by mist generator 50 are discharged outside from these discharge ports 20*a*, 20*b*, and then act on the hair or skin. Circuit section 24 applies voltages to generators 30, 40, and 50.

In air-tunnel 9B, fan 5B that generates airflow W, and motor 7B that rotates fan 5B are disposed. The metal particulates produced by metal particulate generators 30, 40, and the mist produced by mist generator 50 are discharged together with branched airflow Wp. Motor 7B and fan 5B are accommodated in air-tunnel 9B formed in housing 3B. Motor 7B is driven by a driver circuit included in circuit section 24.

Opening 1*h* working as a suction port of air is formed at a base-end (lower side in FIG. 23) of housing 3B. Spin of fan 5B allows air to enter air-tunnel 9B via opening 1*h*, thereby forming airflow W, which travels through air-tunnel 9B and then is discharged toward brush 23. Airflow W is blown out from blow-out holes 23*b* formed at the roots of bristles 23*a*.

Charge supply panel 1*f* is exposed from the surface of handle 1*a* to avoid blocking the discharge of the metal particulates, because electric charges on the user causes blocking the discharge.

Shielding wall 22B is prepared in order to prevent the mist produced by mist generator 50 from traveling to metal particulates generators 30, 40.

The foregoing hair dryer 1B produces similar actions and advantages to those discussed in the foregoing embodiment.

In the above examples, the metal particulate generator that generates metal particulates and minus ions is exemplified; however, a generator that does not produce the metal particulates but produces only the minus ions can be employed.

The present disclosure is applicable to an ion generator that produces plus-ion. This case is effective to hair attached with artificial hair such as wig. Since the artificial hair including wig is tend to be charged minus, a supply of plus ion allows reducing static electricity.

In the embodiment discussed above, a generator that produces mist, and a generator that produces minus ion are used. Specifically the minus-ion generator that is formed of a discharge electrode and a discharge-opposite electrode is exemplified; however, a second electrode can be disposed at a place not confronting the discharge electrode.

In the foregoing embodiment, two blow-out ports for metal particulate are exemplified; however, the number of blow-out port can be three or more than three.

In the foregoing embodiment, branched airflows are used for blowing metal particulates and mist; however, the metal particulates and the mist can be blown out through corresponding blow-out ports without the branched airflow.

A hair-care cosmetic agent can be discharged from the hair dryer. The hair-care cosmetic agent gives hair-care effect to hairs, and yet, a production amount of the hair-care cosmetic agent can be reduced when the hair is in a rather dried state, so that the hair-care effect can increase. The hair-care cosmetic agent is, for instance, an agent containing an oil component.

The cover, housing, and other details (shape, size, layout and the like) can be modified appropriately as well.

As discussed above, the heating blower according to the present disclosure allows supplying a component in an adequate amount to a dry state of hair, so that hair-care effect can be improved, for instance, the hair can be bound up more easily and have a smooth feel. The heating blower can be thus used, for instance, as a dryer for pets as well.

What is claimed is:

1. A heating blower comprising:

a housing constituting an enclosure and including inside the housingablowing path extending from a suction port to a discharge port;

a fan disposed in the housing on a side of the suction port for generating an airflow in the blowing path;

a heater disposed in the housing on a side of the discharge port for heating the airflow;

a generator disposed in the housing for generating a component and supplying the component to the airflow, and including at least one of an ion generator for generating an ion, an acid component generator for generating an acid component, and a charged particulate liquid generator for generating a charged particulate liquid; and a controller for controlling an amount of the component generated by the generator, wherein the controller performs control such that the amount of the component generated by the generator decreases after a lapse of predetermined time or with a lapse of time from an operation start of the generator.

2. The heating blower according to claim 1, wherein the controller includes a first control mode that sets an amount of at least one of the components generated by the generator to a given amount, and a second control mode that sets an amount of the at least one of the components generated by the generator to an amount smaller than the amount set by the first control mode.

3. The heating blower according to claim 1, wherein the controller performs control such that the generator halts the operation for a given time before the amount of at least one of the components generated by the generator decreases.

4. The heating blower according to claim 1 further comprising a charge supply panel, which is capable of changing a charged state of hair, in vicinity to a handle, wherein the controller controls an amount of electric charges of the charge supply panel.

5. The heating blower according to claim 2, wherein the controller performs control such that the generator halts the operation for a given time before the amount of at least one of the components generated by the generator decreases.

* * * * *